US007322133B2

(12) United States Patent
Horton

(10) Patent No.: US 7,322,133 B2
(45) Date of Patent: Jan. 29, 2008

(54) MULTI-SHANK RIPPER

(76) Inventor: Lee A. Horton, 72 Heather Cir., Jefferson, MA (US) 01522

( * ) Notice: Subject to any disclaimer, the term of this patent is extended or adjusted under 35 U.S.C. 154(b) by 159 days.

(21) Appl. No.: 11/214,607

(22) Filed: Aug. 29, 2005

(65) Prior Publication Data

US 2006/0070267 A1 Apr. 6, 2006

Related U.S. Application Data

(63) Continuation-in-part of application No. 10/762,733, filed on Jan. 22, 2004, now abandoned.

(60) Provisional application No. 60/442,031, filed on Jan. 23, 2003, provisional application No. 60/631,525, filed on Nov. 29, 2004.

(51) Int. Cl.
*E02F 3/96* (2006.01)

(52) U.S. Cl. ..... 37/404

(58) Field of Classification Search ..... 37/404, 37/405, 406, 407, 444, 403, 468
See application file for complete search history.

(56) References Cited

U.S. PATENT DOCUMENTS 2,615,262 A 10/1952 Reid, Sr.
2,660,323 A 11/1953 Carlesimo
2,838,856 A * 6/1958 Buisse ..... 37/404
3,724,899 A 4/1973 Clark
4,037,337 A 7/1977 Hemphill
4,038,766 A 8/1977 Felstet
4,041,624 A 8/1977 Fryrear
4,077,529 A 3/1978 Leyrat et al.
4,133,121 A * 1/1979 Hemphill ..... 37/444
4,204,348 A 5/1980 Lydie
4,217,962 A 8/1980 Schaefer
4,238,896 A * 12/1980 Lanz et al. ..... 37/450
4,279,085 A 7/1981 Arnold
4,321,762 A 3/1982 Hemphill
4,351,397 A * 9/1982 Winker ..... 172/464
4,457,085 A 7/1984 Arnold
4,476,641 A 10/1984 Ballinger (Continued)

OTHER PUBLICATIONS

"Couplers and Attachments for Construction Equipment"; *DigNRipBucket*; Leading Edge Attachments, Inc.; 2002-2004.

(Continued)

*Primary Examiner*—Victor Batson
(74) *Attorney, Agent, or Firm*—Fish & Richardson P.C.

(57) ABSTRACT

A multi-shank ripper excavation tool has a body mounted from an arm, e.g. a dipper arm or a boom arm, and at least first and second shanks mounted to the body. Each shank is perpendicular to an axis of rotation of the tool, and each the shank includes a ripper tooth positioned for ripping engagement with a substrate. The shanks and ripper teeth are laterally spaced apart along the axis of rotation relative to the arm, and the ripper teeth are angularly spaced apart in a direction of substrate ripping motion. In some implementations, plates are mounted to span a region between two or more shanks, rearward of the teeth in a direction of ripping motion, and define, with the shanks, a bucket volume for receiving material ripped from the substrate. Methods for ripping excavation of a substrate employing the above excavation tools mounted on a dipper stick or a boom arm are also described.

61 Claims, 21 Drawing Sheets

U.S. PATENT DOCUMENTS

| | | | | |
|---|---|---|---|---|
| 4,516,339 | A * | 5/1985 | Hemphill | 37/454 |
| 4,616,433 | A | 10/1986 | Knell et al. | |
| 4,808,027 | A | 2/1989 | Anderson | |
| RE33,198 | E | 4/1990 | Bellinger | |
| 5,084,990 | A * | 2/1992 | Briscoe | 37/398 |
| 5,456,028 | A | 10/1995 | Larson | |
| 5,992,062 | A | 11/1999 | Evans et al. | |
| 6,328,114 | B1 | 12/2001 | Ritchie et al. | |
| 6,626,499 | B1 | 9/2003 | Schenk et al. | |

OTHER PUBLICATIONS

"Wain Roy™ Ripper Bucket™"; Woods Equipment Company; 1998.

Wain-Roy® Ripper Bucket™ For Severe Digging; Wain Roy® Inc.

* cited by examiner

MULTI-SHANK RIPPER

TECHNICAL FIELD

This application is a continuation-in-part of U.S. application Ser. No. 10/762,733, filed Jan. 22, 2004 now abandoned, which claims benefit from U.S. Provisional Application No. 60/442,031, filed Jan. 23, 2003, now abandoned. This application also claims benefit from U.S. Provisional Application No. 60/631,525, filed Nov. 29, 2004, now pending. The complete disclosures of all of these application are incorporated herein by reference.

This disclosure relates to excavation tools, and more particularly to ripper type and ripper-and-bucket type excavation tools.

BACKGROUND

Excavation tools of the types described herein are typically mounted to conventional excavators of the type having a backhoe. The backhoe includes a dipper stick, and the tool is mounted on the outboard end of the dipper stick. The tools are employed for excavation of difficult-to-excavate intermediate substrate, e.g. substrate between the category of loose soil or loose gravel and the category of solid rock. Intermediate substrate requires special tools to be excavated efficiently. Loose soil or gravel can be excavated with a conventional bucket, but a conventional bucket is generally not effective in intermediate substrate. Solid rock excavation generally requires a hydraulic hammer, but a hydraulic hammer is not efficient for excavating intermediate substrate. Attempts have been made to develop tools that are effective and efficient in excavating intermediate substrate. Simply stated, there have been three general approaches, i.e. the single tooth approach; the added articulated tooth approach, in which a tooth is positioned behind the bucket; and the multi-tooth bucket approach, where several teeth are mounted on the back side of the bucket, e.g. as described in Arnold U.S. Pat. No. 4,279,085 and Arnold U.S. Pat. No. 4,457,085, the complete disclosures of each of which are incorporated herein by reference. Each of these approaches has been found to have drawbacks and none is efficient and effective for excavation of intermediate substrate.

SUMMARY

According to a first aspect of the disclosure, a multi-shank ripper excavation tool for use mounted to an arm, e.g. a dipper arm or a boom arm, of an excavation machine comprises a body mounted for rotation from the arm, and at least one set of multiple shanks mounted to the body, each shank of each set of multiple shanks being disposed generally perpendicular to an axis of rotation of the multi-shank ripper excavation tool relative to the arm, and each shank of each set of multiple shanks comprising a ripper tooth disposed at a forward end thereof for ripping engagement with a substrate. Each set of multiple shanks comprises at least a first shank comprising a first ripper tooth disposed at a forward end thereof for ripping engagement with the substrate, and a second shank comprising a second ripper tooth disposed at a forward end thereof for ripping engagement with the substrate, the second shank being laterally spaced from the first shank along the axis of rotation of the multi-shank ripper excavation tool relative to the arm, and the second ripper tooth being angularly spaced from the first ripper tooth in a direction of substrate ripping motion.

Preferred implementations of this aspect of the disclosure may include one or more of the following additional features. The first ripper tooth is angularly advanced relative to the second ripper tooth in a direction of substrate ripping motion, whereby the first ripper tooth is engaged for ripping the substrate before the second ripper tooth is engaged for ripping the substrate. The at least one set of multiple shanks further comprises at least a third shank comprising a third ripper tooth disposed at a forward end thereof for ripping engagement with a substrate, the third shank being laterally spaced from the first shank and from the second shank along the axis of rotation of the multi-shank ripper excavation tool relative to the arm, and the third ripper tooth being angularly spaced from the first ripper tooth and from the second ripper tooth in a direction of ripping motion. Preferably, the first ripper tooth is angularly advanced relative to the second ripper tooth in a direction of ripper rotation and the second ripper tooth is angularly advanced relative to the third ripper tooth in a direction of ripping rotation, whereby the first ripper tooth is engaged for ripping the substrate before the second ripper tooth and the third ripper tooth are engaged for ripping the substrate, and the second ripper tooth is engaged for ripping the substrate before the third ripper tooth is engaged for ripping the substrate. The set of multiple shanks further comprises additional shanks, each comprising a ripper tooth disposed at a forward end thereof for ripping engagement with a substrate, each additional shank being laterally spaced from each other shank along the axis of rotation of the multi-shank ripper excavation tool relative to the arm, and the ripper tooth of each additional shank being angularly spaced from the ripper tooth of each other of the additional shanks in a direction of ripping motion. The ripper tooth is replaceably mounted to the shank. The ripper tooth is integral with the shank. The multi-shank ripper excavation tool further comprises one or more plate members mounted to span a region between two of more shanks of the set of multiple shanks, rearward of the ripper teeth in a direction of ripping motion and defining, with the two or more of the shanks, a bucket volume for receiving material ripped from the substrate during ripping motion. The body portion comprises a body upper portion and a body tubular cross brace portion. Each ripper tooth comprises a nosepiece adapter. Each ripper tooth terminates in a tip, and each ripper tooth is disposed at a predetermined angle to a tangent to an arc extending generally through each tip. The arc is centered at, near, or above a dipper pivot point. The predetermined angle is between about 20° and about 50° from the tangent. Each ripper tooth has a top cutting surface and a bottom cutting surface. Each top cutting surface is disposed at an angle of between about 35° and about 70° from the tangent. The ripping teeth are selected from the group consisting of: tiger points, twin or double tiger points, and crawler tractor ripping teeth. One or more of the ripping teeth comprises twin or double tiger points that are spaced apart laterally and spaced apart angularly in a direction of ripping motion. The angular spacing between adjacent ripper teeth in a direction of ripping motion is between about 15° and about 30°, and preferably about 20°. A tip radius dimension between the dipper stick pivot and each ripper tooth tip is at least about 20% less than a tip radius dimension of a conventional bucket. The one or more plate members define one or more leading edges angled in a direction of angular spacing of the ripper teeth. The multiple shanks comprise at least two sets of multiple shanks. The two sets of multiple shanks are arrayed in a mirror configuration or in a side-by-side transformation. The arm is a dipper arm or a boom arm.

According to another aspect of the disclosure, a multi-shank ripper excavation tool for use mounted to an arm, e.g. a dipper arm or a boom arm, of an excavation machine comprises a body mounted for rotation from the arm, and at least one set of multiple shanks mounted to the body, each shank of each set of multiple shanks being disposed generally perpendicular to an axis of rotation of the multi-shank ripper excavation tool relative to the arm, and each shank of each set of multiple shanks comprising a ripper tooth disposed at a forward end thereof for ripping engagement with a substrate. Each set of multiple shanks comprises at least a first shank comprising a first ripper tooth disposed at a forward end thereof for ripping engagement with the substrate, and a second shank comprising a second ripper tooth disposed at a forward end thereof for ripping engagement with the substrate, the second shank being laterally spaced from the first shank along the axis of rotation of the multi-shank ripper excavation tool relative to the arm, and the second ripper tooth being angularly spaced from the first ripper tooth in a direction of substrate ripping motion, and the multi-shank ripper excavation tool further comprising one or more plate members mounted to span a region between two or more shanks of the set of multiple shanks, rearward of the ripper teeth in a direction of ripping motion and defining, with the two or more shanks, a bucket volume for receiving material ripped from the substrate during ripping motion.

Preferred implementations of this aspect of the disclosure may include one or more of the following additional features. The first ripper tooth is angularly advanced relative to the second ripper tooth in a direction of substrate ripping motion, whereby the first ripper tooth is engaged for ripping the substrate before the second ripper tooth is engaged for ripping the substrate. The set of multiple shanks further comprises at least a third shank comprising a third ripper tooth disposed at a forward end thereof for ripping engagement with a substrate, the third shank being laterally spaced from the first shank and from the second shank along the axis of rotation of the multi-shank ripper excavation tool relative to the arm, and the third ripper tooth being angularly spaced from the first ripper tooth and from the second ripper tooth in a direction of ripping motion. The first ripper tooth is angularly advanced relative to the second ripper tooth in a direction of ripper rotation and the second ripper tooth is angularly advanced relative to the third ripper tooth in a direction of ripping rotation, whereby the first ripper tooth is engaged for ripping the substrate before the second ripper tooth and the third ripper tooth are engaged for ripping the substrate, and the second ripper tooth is engaged for ripping the substrate before the third ripper tooth is engaged for ripping the substrate. The set of multiple shanks further comprises additional shanks, each comprising a ripper tooth disposed at a forward end thereof for ripping engagement with a substrate, each additional shank being laterally spaced from each other shank along the axis of rotation of the multi-shank ripper excavation tool relative to the arm, and the ripper tooth of each additional shank being angularly spaced from the ripper tooth of each other of the additional shanks in a direction of ripping motion. The ripper tooth is replaceably mounted to the shank. The ripper tooth is integral with the shank. The body portion comprises a body upper portion and a body tubular cross brace portion. Each ripper tooth comprises a nosepiece adapter. Each ripper tooth terminates in a tip, and each ripper tooth is disposed at a predetermined angle to a tangent to an arc extending generally through each tip. The arc is centered at, near, or above a dipper stick pivot. The predetermined angle is between about 20° and about 50° from the tangent. Each ripper tooth has a top cutting surface and a bottom cutting surface. Each top cutting surface is disposed at an angle of between about 35° and about 70° from the tangent. The ripping teeth are selected from the group consisting of: tiger points, twin or double tiger points, and crawler tractor ripping teeth. One or more of the ripping teeth comprises twin or double tiger points that are spaced apart laterally and spaced apart angularly in a direction of ripping motion. The angular spacing between adjacent the ripper teeth in a direction of ripping motion is between about 15° and about 30°, and preferably about 20°. A tip radius dimension between the dipper stick pivot and each ripper tooth tip is at least about 20% less than a tip radius dimension of a conventional bucket. One or more plate members define one or more leading edges angled in a direction of angular spacing of the ripper teeth. One or more intermediate ripping teeth of the set of ripping teeth are mounted to the leading edge. The multiple shanks comprise at least two sets of multiple shanks. The two sets of multiple shanks are arrayed in a mirror configuration or in a side-by-side transformation. The arm is a dipper arm or a boom arm.

According to another aspect of the disclosure, a multi-shank ripper excavation tool for use mounted to an arm, e.g. a dipper arm or a boom arm, of an excavation machine comprises a body mounted for rotation from the arm, multiple shanks mounted to the body, each shank being disposed generally perpendicular to an axis of rotation of the multi-shank ripper excavation tool relative to the arm, one or more plate members mounted to span a region between two or more shanks, rearward of the ripper teeth in a direction of ripping motion, and defining, with two or more of shanks, a bucket volume for receiving material ripped from the substrate during ripping motion, the plates members defining a leading edge, and at least one set of multiple ripper teeth disposed for ripping engagement with a substrate, the set of multiple ripper teeth comprising a ripper tooth disposed at a forward end of each shank and one or more ripper teeth mounted to the leading edge. In each set of multiple ripper teeth, a first ripper tooth is disposed at a forward end of a first shank, and a second ripper tooth is laterally spaced from the first ripper tooth along the axis of rotation of the multi-shank ripper excavation tool relative to the arm, and the second ripper tooth is angularly spaced from the first ripper tooth in a direction of ripping motion.

Preferred implementations of this aspect of the disclosure may include one or more of the following additional features. The leading edge is angled in a direction of angular spacing of the set of multiple ripper teeth. The multi-shank ripper excavation tool comprises at least two sets of multiple ripper teeth, wherein the leading edge defined by the plate members has at least two angular components and each angular component supports ripper teeth of discrete sets of multiple ripper teeth. The two angular components of the leading edge supporting ripper teeth of discrete sets of multiple ripper teeth are arrayed in a mirror configuration or in a side-by-side transformation. One or more of the ripping teeth comprises twin or double tiger points that are spaced apart laterally and spaced apart angularly in a direction of ripping motion. The arm is a dipper arm or a boom arm.

According to still another aspect of disclosure, a method for ripping excavation of a substrate employing a multi-shank ripper excavation tool mounted to an excavation machine comprises the steps of engaging a first ripper tooth of the multi-shank ripper excavation tool with the substrate surface to be excavated, and applying ripping force only to the first ripper tooth and causing the first ripper tooth to penetrate the substrate in ripping action, thereafter, engaging a second ripper tooth of the multi-shank ripper excavation tool with the substrate surface being excavated, and applying ripping force to the second ripper tooth and causing the second ripper tooth to penetrate the substrate in ripping action, and thereafter engaging, in succession, succeeding ripping teeth of the multi-shank ripper excavation tool with the substrate surface being excavated, and applying ripping force to the succeeding ripping teeth, in succession, and causing the succeeding ripping teeth, in succession, to penetrate the substrate in ripping action.

Preferred implementations of this aspect of the disclosure may include one or more of the following additional features. The method comprises the further steps of, as the first ripper tooth penetrates the substrate surface to break out material from the substrate surface, allowing the tool and dipper stick to nosedive until a second ripper tooth engages the substrate surface with full cylinder force; and as the second ripper tooth penetrates the substrate surface to break out material from the substrate surface, allowing the tool and dipper stick to nosedive until a third ripper tooth engages the substrate surface with full cylinder force. The method further comprises the step of, as each succeeding ripper tooth, in succession, penetrates the substrate surface to break out material from the substrate surface, allowing the tool and dipper stick to nosedive until a still further succeeding ripper tooth, in succession, engages the substrate surface with full cylinder force.

According to yet another aspect of the disclosure, a method for ripping excavation of a substrate employing a multi-shank ripper excavation tool mounted on a dipper stick of an excavation machine comprises the steps of: (a) extending the dipper stick to full extent forward of the excavation machine and pivoting the ripper excavation tool at the end of the dipper stick back to full extent; (b) lowering the dipper stick until a first ripper tooth of the ripper excavation tool engages the substrate to be ripped; (c) drawing the ripper excavation tool toward the excavation machine to cause the first ripper tooth to penetrate the substrate surface in ripping action; (d) simultaneously pivoting the ripper excavation tool forward until a second ripper tooth of the ripper excavation tool engages the surface of the substrate being ripped; (e) drawing the ripper excavation tool toward the excavation machine to cause the second ripper tooth to penetrate the substrate surface in ripping action; and (f) repeating steps (d) and (e) for each succeeding ripper tooth of the ripper excavation tool, in succession.

Drawbacks experienced with the prior art devices have been obviated in a novel manner by the present disclosure. It is, therefore, an outstanding object of the present disclosure to provide excavation tools and systems that efficiently and effectively excavate intermediate substrate.

Another object of this disclosure is to provide excavation tools and systems that allow an operator maximum visibility of the work area for precise excavation, especially around obstacles and utilities.

A further object of the disclosure is to provide excavation tools and systems that apply maximum working force to the working tooth for efficient and effective excavation of intermediate substrate.

It is another object of the disclosure is to provide excavation tools and systems with smooth operation and minimum stress on an excavating vehicle as it efficiently and effectively excavates intermediate substrate.

It is a further object of the disclosure to provide excavation tools and systems capable of high quality and low cost manufacture, with long and useful service life and, minimum of maintenance.

The details of one or more implementations of the disclosure are set forth in the accompanying drawings and the description below. Other features, objects, and advantages of the disclosure will be apparent from the description and drawings, and from the claims.

DESCRIPTION OF DRAWINGS

FIG. 22 is a perspective view of a ripper tooth with two tiger points, as shown in FIG. 21, while

Like reference symbols in the various drawings indicate like elements.

DETAILED DESCRIPTION

This application is related to U.S. Application No. 60/442,031, filed Jan. 23, 2003, now expired, and to U.S. application Ser. No. 10/762,733, filed Jan. 22, 2004, now pending. The complete disclosures of both of these applications are incorporated herein by reference.

Figure 1:
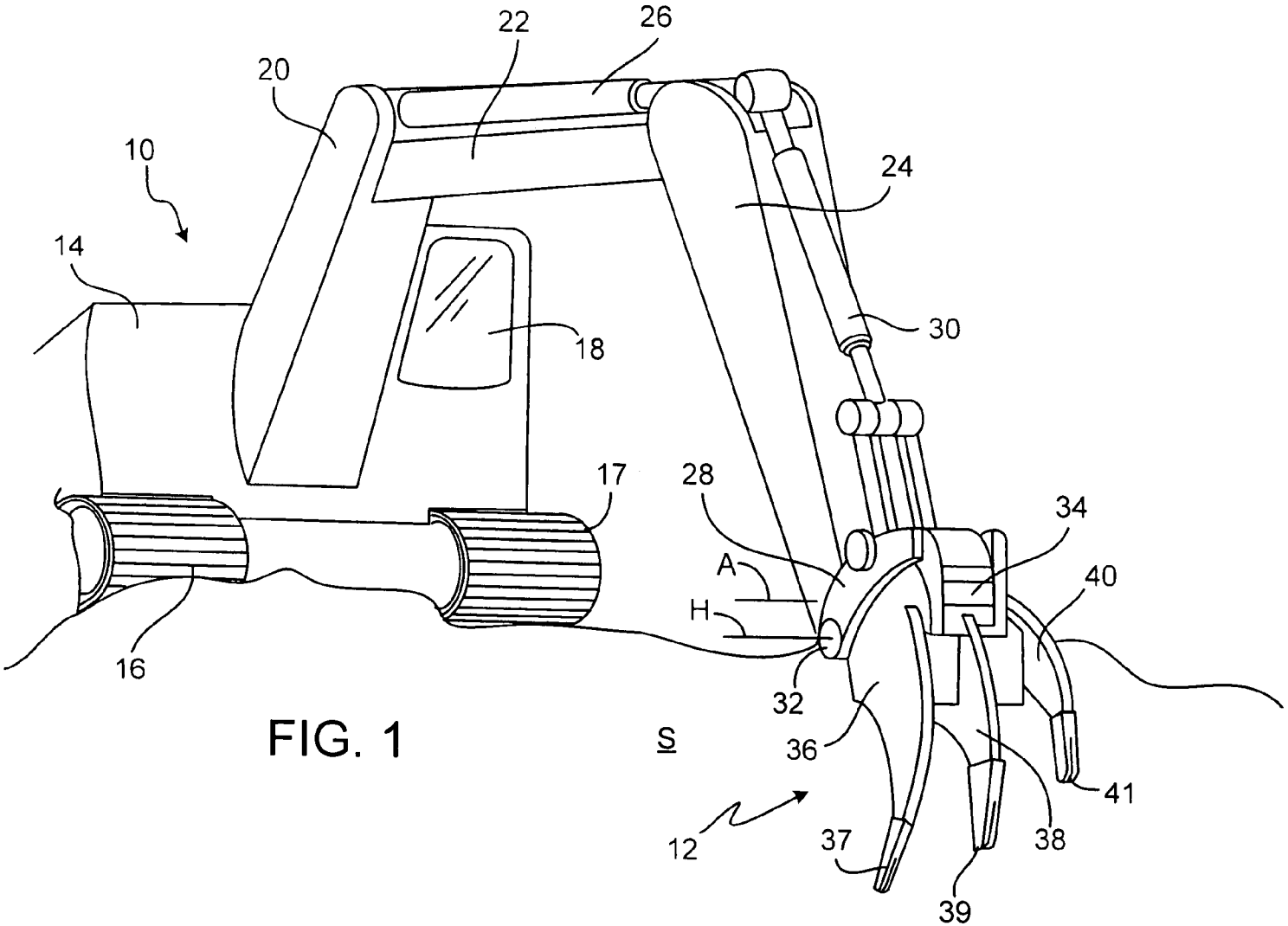
FIG. 1 is a prospective view of a hydraulic excavator fitted with a first implementation of a multi-shank ripper excavation tool of the present disclosure.
Figure 2:
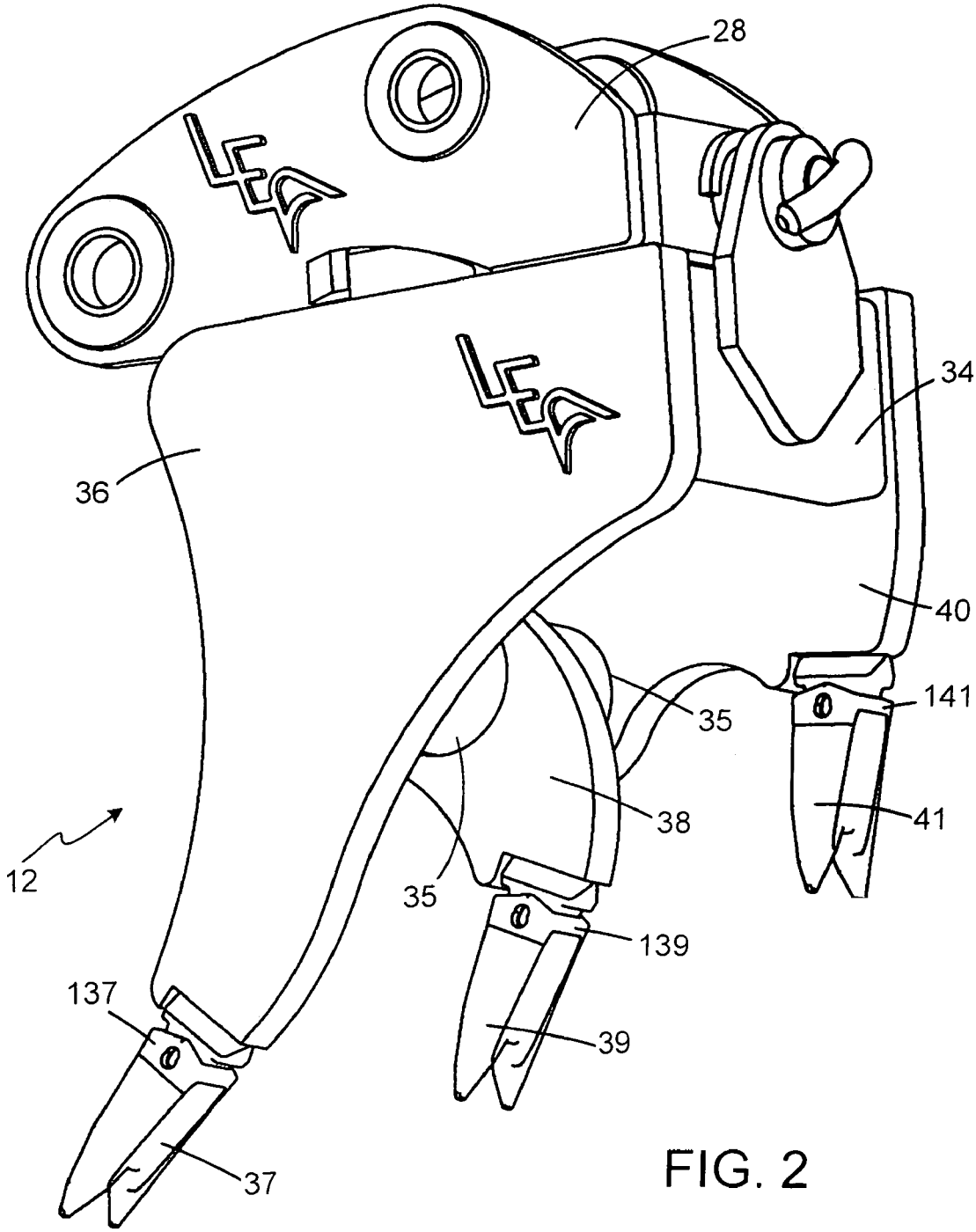
FIG. 2 is a right rear prospective view of the multi-shank ripper excavation tool of FIG. 1.
Figure 3:
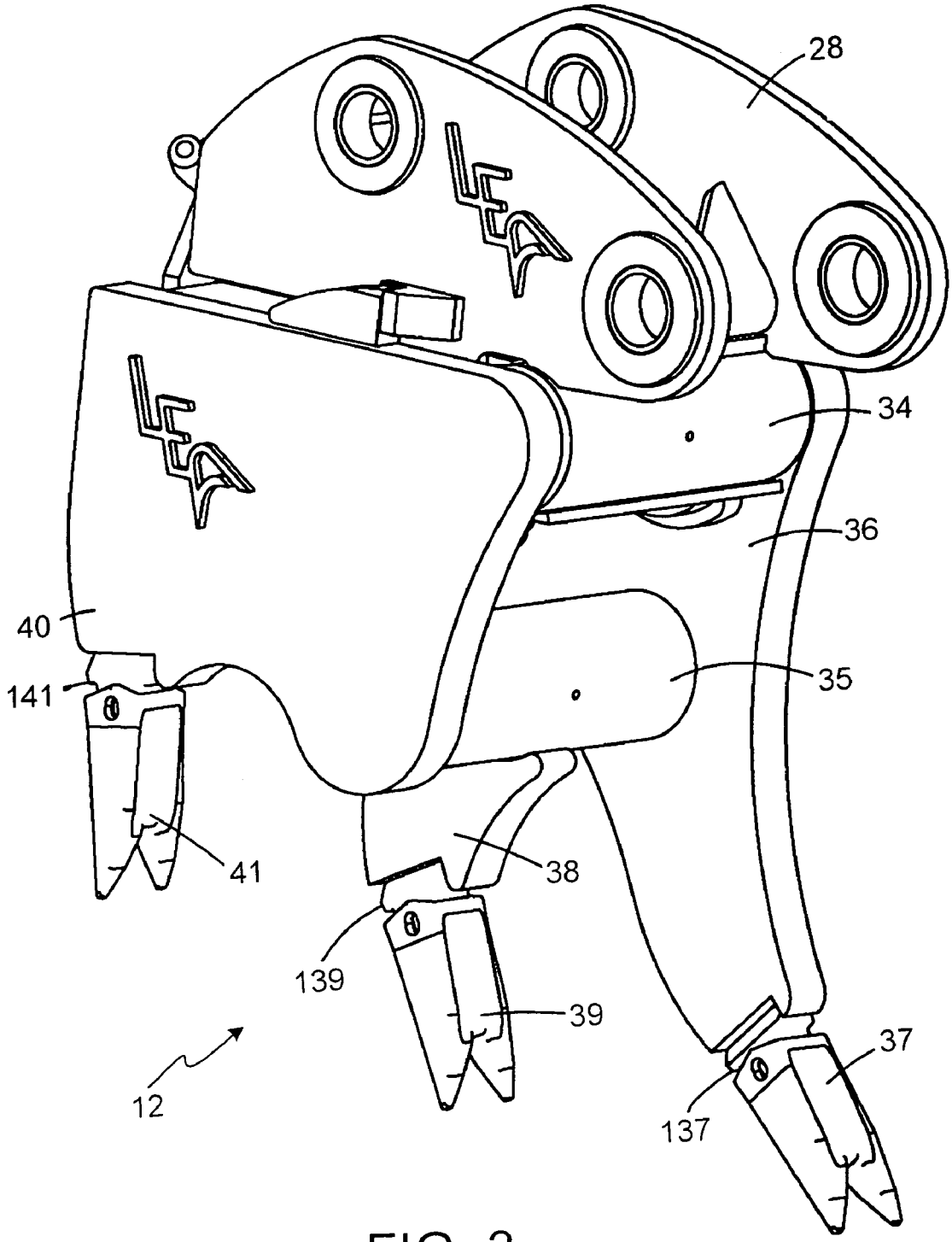
FIG. 3 is a left front prospective view of the multi-shank ripper excavation tool of FIG. 1.

Referring first to FIG. 1, a hydraulic excavator 10, e.g. of the type suited for use with a multi-shank ripper excavation tool 12 of the present disclosure, has a chassis 14, tracks 16 and 17 for mobility, and a cab 18 for the operator. Extending from the chassis 14 is an arm 20, with a boom 22 pivotally attached to the outboard end of the arm, and a dipper stick 24 pivotally attached to the outboard end of the boom. A hydraulic actuator 26 articulates the dipper stick 24.

In FIG. 1, the multi-shank ripper excavation tool 12 is mounted to the outboard end of the dipper stick 24 of the hydraulic excavator 10 by means of a quick-change coupler mechanism 28. A second hydraulic actuator 30 articulates the multi-shank ripper excavation tool 12 generally about an axis, A (FIG. 4), preferably located near and generally above and forward of the dipper pivot rotation center, i.e., the axis, H, of hinge pin 32, e.g. for ripping engagement with the substrate, S.

Referring also to FIGS. 2 through 5, the multi-shank ripper excavation tool 12 has a body including a body upper portion 34, constructed for secure, releasable connection to the lower side of the quick-change mechanism 28, and a body tubular cross brace portion 35. The quick-connect coupler mechanism 28, in turn, is connected to the dipper stick 24 and the hydraulic actuator 30 (FIG. 1). A set of multiple ripper shanks, e.g. at least two shanks, and preferably at least three shanks, as shown, or more, are mounted to the body, i.e. outer rippers shanks 36, 40 are mounted to body upper portion 34 with the body tubular cross brace portion 35 extending therebetween, and intermediate or center ripper shank 38 is mounted directly to the tubular cross brace portion 35. In other implementations, e.g. as described below, the center ripper shank 38 may be attached directly to the body upper portion 34, but the body cross tube portion 35 contributes considerable torsional rigidity, so lower stresses are apparent throughout, thus reducing the problem of fatigue cracks. In the preferred implementation, the shanks 36, 38, 40, which are designed to withstand high breakout forces, are formed of thick plates; however, hollow structures of suitable strength may also be employed.

Figure 4:
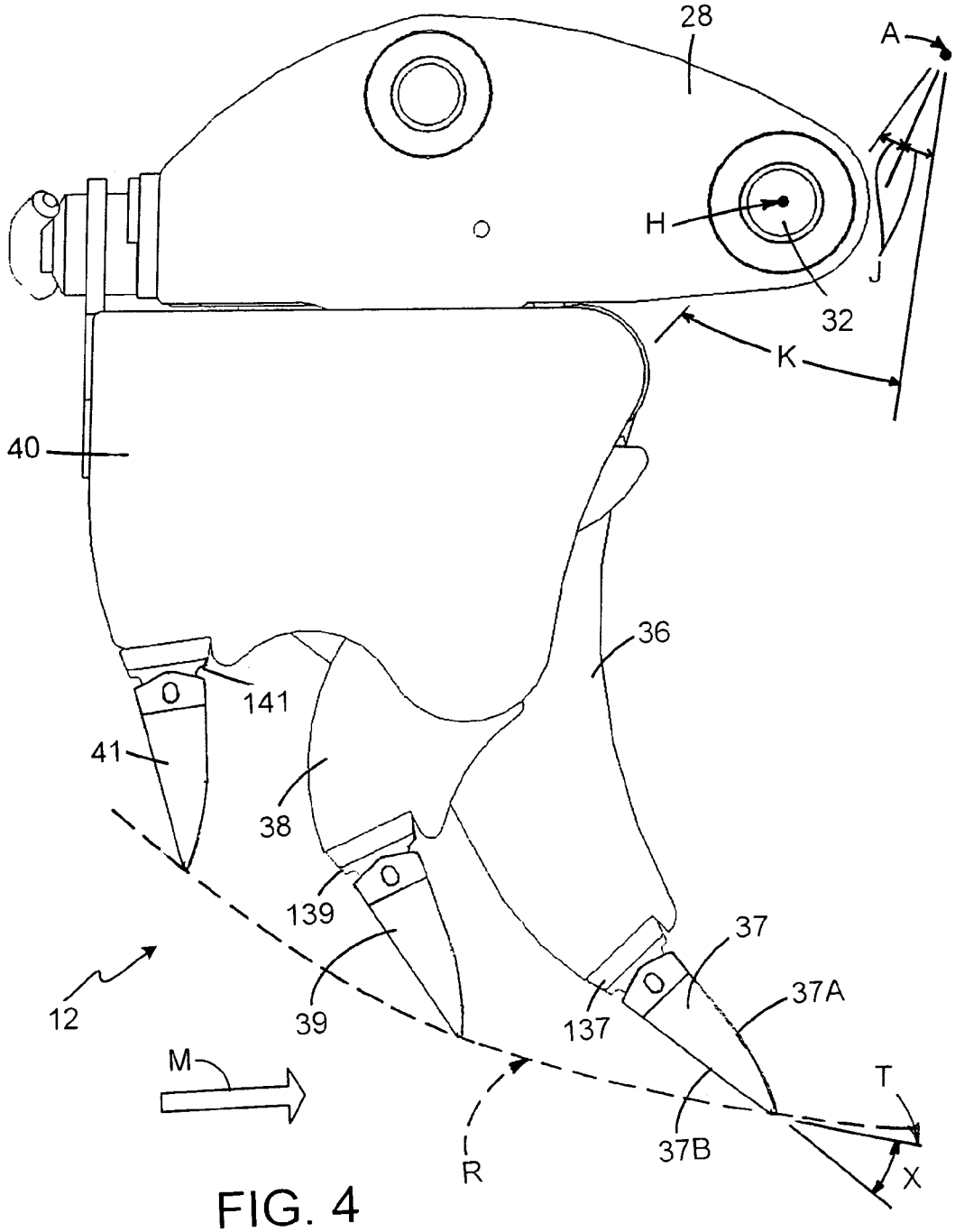
FIG. 4 is a left side view of the multi-shank ripper excavation tool of FIG. 1.
Figure 5:
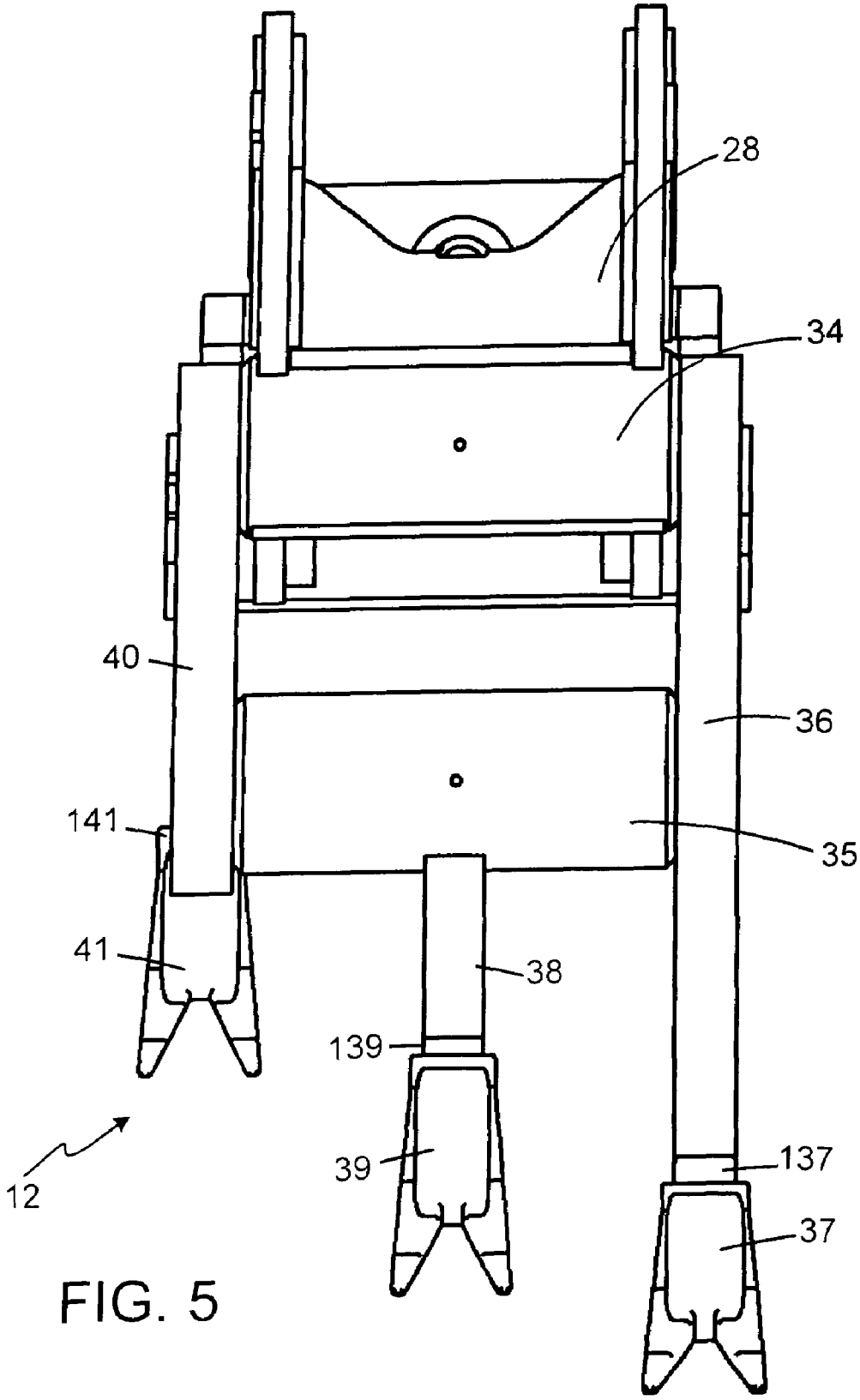
FIG. 5 is a front view of the multi-shank ripper excavation tool of FIG. 1.
Figure 16:
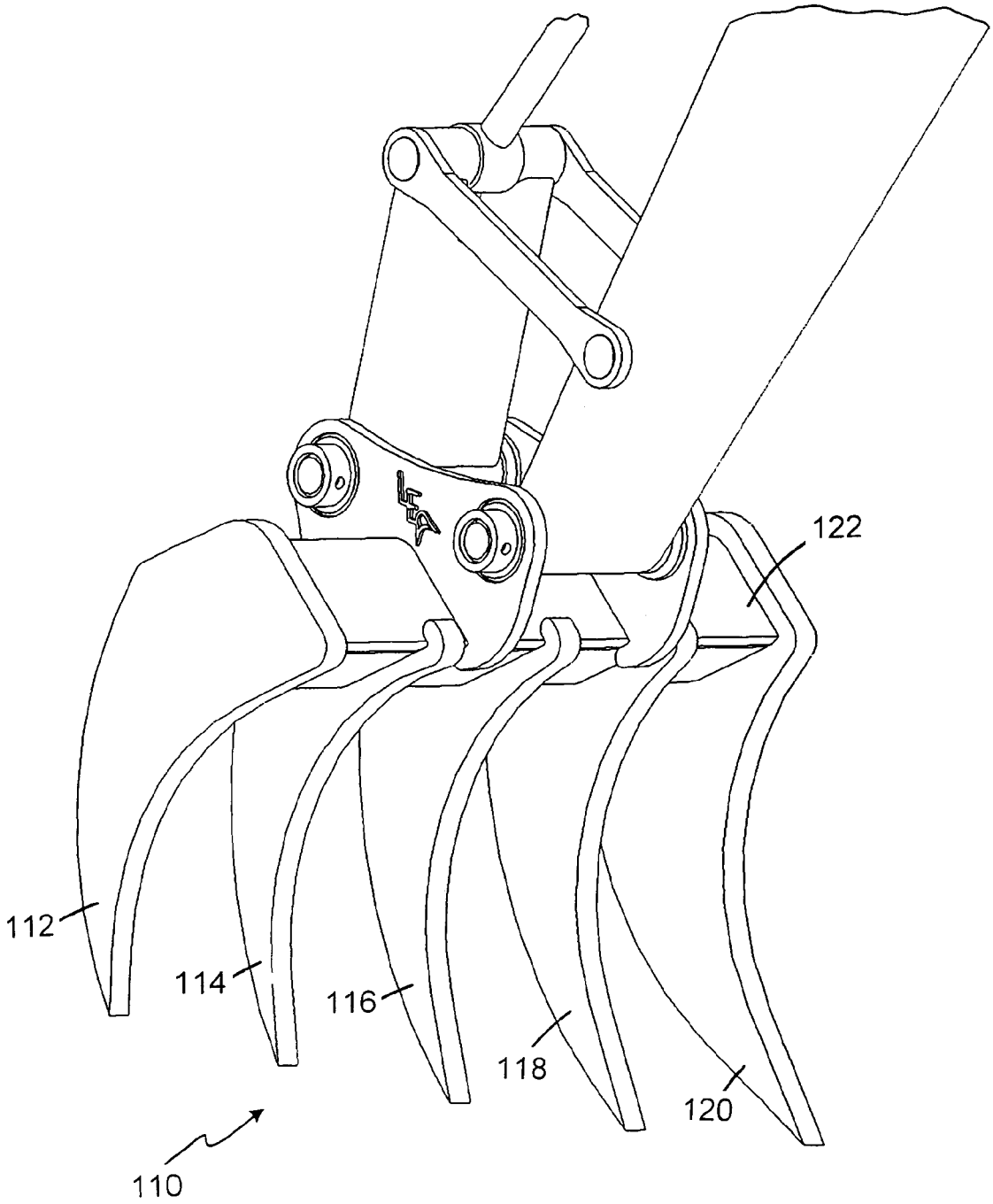
FIG. 16 is a left front prospective view of still another implementation of a multi-shank ripper excavation tool of the disclosure in the form of a rake having five shanks.

Referring to FIG 4, each of the multiple ripper shanks 36, 38, 40 terminates in a ripper tooth 37, 39, and 41, respectively, mounted to, as shown, or alternatively formed at (e.g. as shown in FIG 16), the outboard end of the associated ripper shank. Each ripper tooth 37, 39, 41 is connected to a nose piece adapter 137, 139, 141, respectively, which is easily welded at the tip of the associated shank 36, 38, 40, respectively. Each ripper tooth is disposed at approximately the same angle, X, to a tangent, T, to the arc, R, drawn through the tips of the ripper teeth 37, 39, 41 and centered at axis, A, located near and generally above and forward of the dipper pivot rotation center, the axis, H, of hinge pin 32. The optimum angle, X, depends on tooth manufacture, but the center line of the ripper tooth as viewed from the side typically lies in the range of about 20° to about 50° degrees from the tangent, T. The ripper tooth usually has a top cutting surface 37A and a bottom-cutting surface 37B. The top surface 37A typically is disposed at an angle in the range of about 35° to about 70° from the tangent, T. The ripper teeth can be any style suited for penetration of the substrate to be excavated, e.g. such as tiger points or twin or double tiger points. Other tooth designs may be employed, including, e.g., for other applications, such as stump removal.

The ripper teeth 37, 39, 41 are laterally spaced from each other along the axis, A, of rotation of the multi-shank ripper excavation tool 12 relative to the dipper stick 24. The ripper teeth 37, 39, 41 are also angularly spaced from each other about the axis of rotation, A, in the direction of ripping motion (arrow, M). In particular, each ripper tooth is spaced from the preceding ripper tooth by an angular offset, J, e.g. approximately 15° to 30° (preferably about 20°), with the total angular offset, K, from ripper tooth 37 to ripper tooth 41 of approximately 30° to 60° (preferably about 40°).

The tips of the ripper teeth 37, 39, 41 are positioned to lie on the arc, R, so that, in the case of a pin-on version, if the operator chooses to use a quick connect coupler 28, the arc, R, approximately aligns with the dipper pivot of the coupler, which is usually higher and forward of the original dipper pivot. Since the ripping action usually comprises a combination of bucket cylinder rolling and stick raking action, the cutting angles are optimized by keeping this arc center, A, above and forward of the dipper pivot rotation center.

In preferred implementations, and as described above, the multi-shank ripper excavation tool 12 has three removable ripper teeth 37, 39, 41 positioned with the tooth tips on the arc, R, having its arc center, A, very close to and above the dipper pivot axis, H, as best seen in FIG. 4. There can be any number of teeth (two or three or more). From side to side, generally along the axis of the arc center, A, the ripper teeth do not lie in the same plane. In the preferred implementation, the first engaging ripper tooth 37 is on the right side, the second ripper tooth 39 is in the middle, and the third ripper tooth 41 is on the left. The ripper teeth 37, 39, 41 can be positioned differently, as long as the tooth tips lie on the arc, R (as viewed from the side), and the ripper teeth are not in the same plane. Although, in the implementation of the disclosure shown in the drawings, right outboard tooth 37 is forward, intermediate or central tooth 39 is in the middle and left outboard tooth 41 is a rearward, other arrangements can be employed according to the disclosure, as long as the ripper teeth are disposed in forward, intermediate or central, and rearward positions for ripper excavation tools having three ripper teeth. For example, the center tooth 39 could be the first engaging tooth, and then the right tooth 37 engaging next, followed by the left tooth 41.

Figure 6:
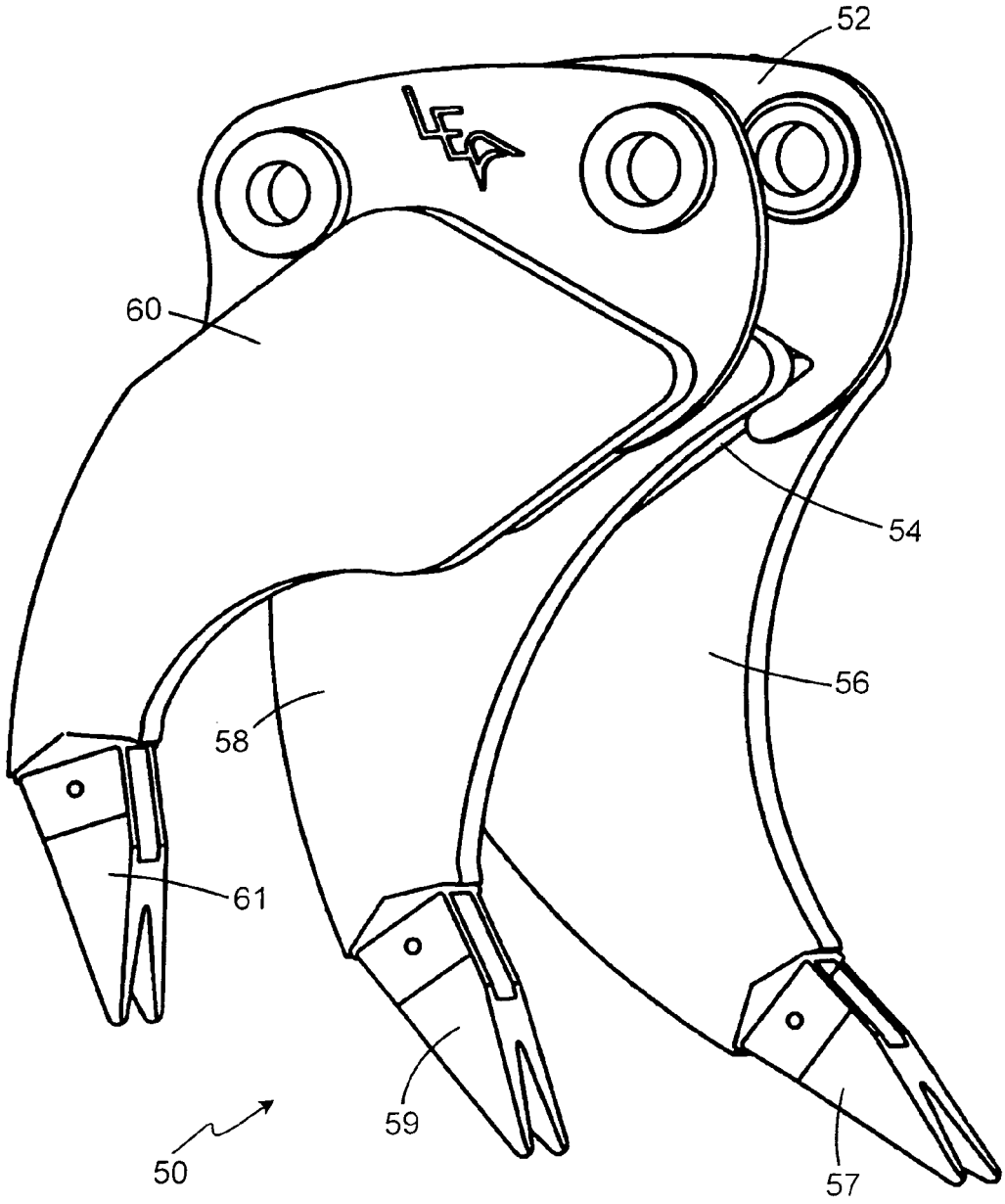
FIG. 6 is a left front perspective view of another implementation of a multi-shank ripper excavation tool of the present disclosure.
Figure 7:
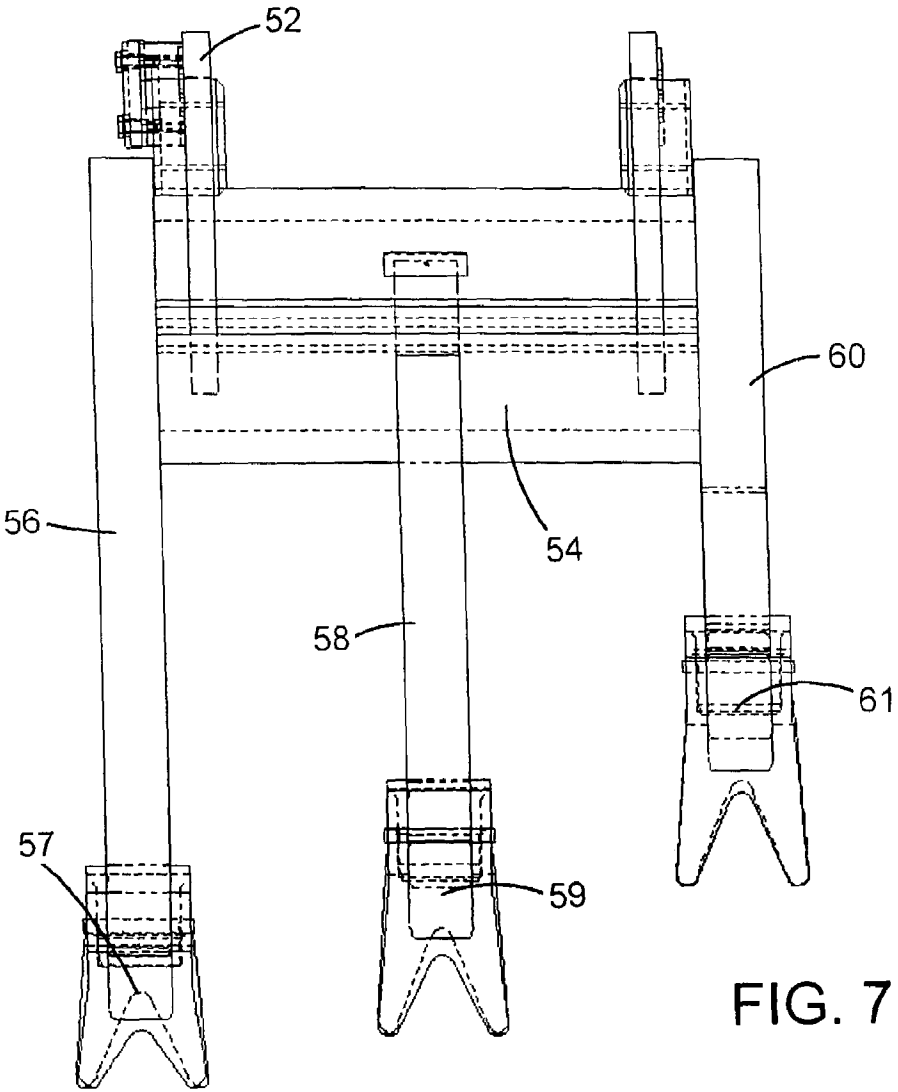
FIG. 7 is a rear view of the multi-shank ripper excavation tool of FIG. 6.
Figure 8:
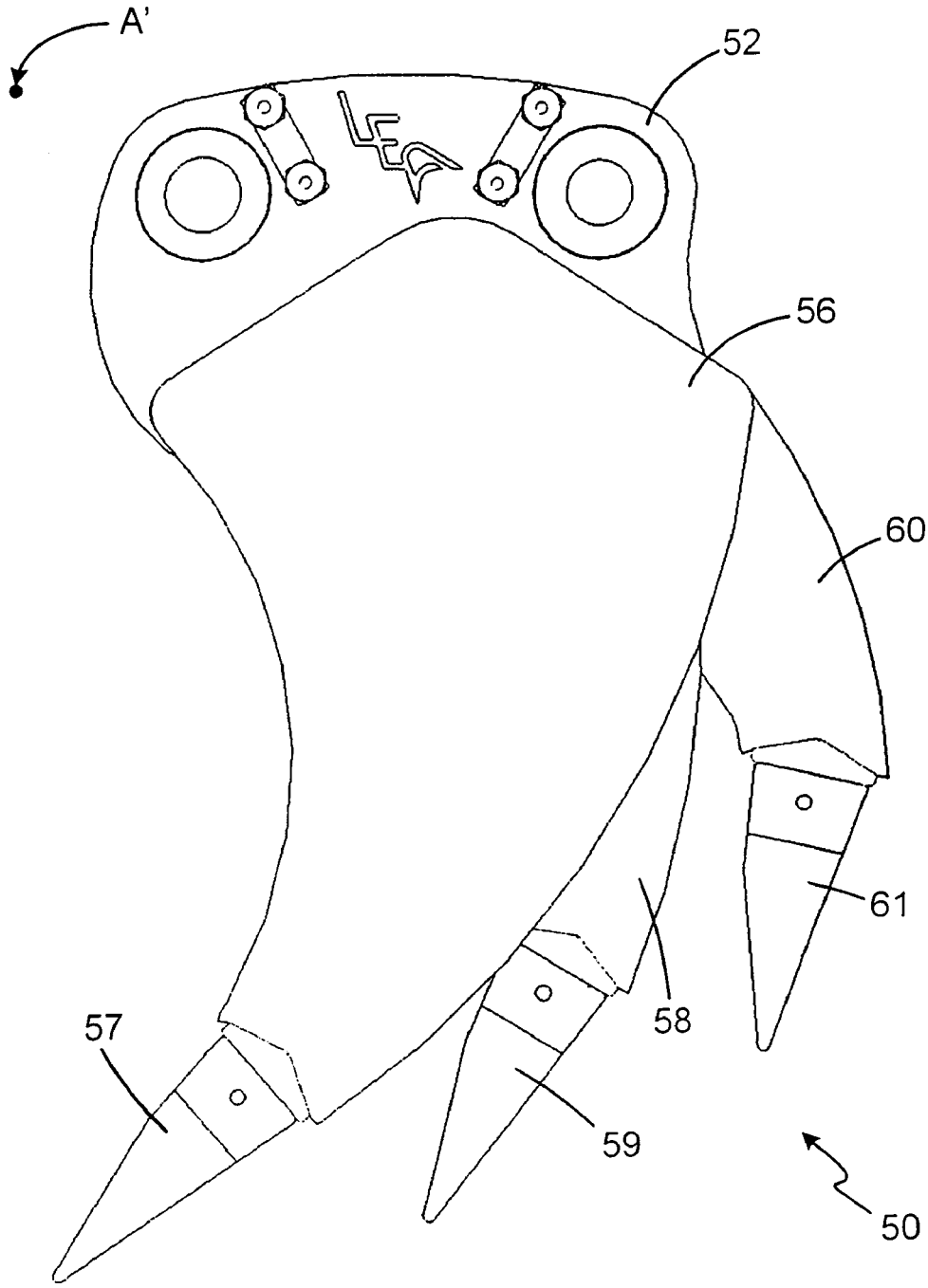
FIG. 8 is a side view of the multi-shank ripper excavation tool of FIG. 6.
Figures 9, 10:
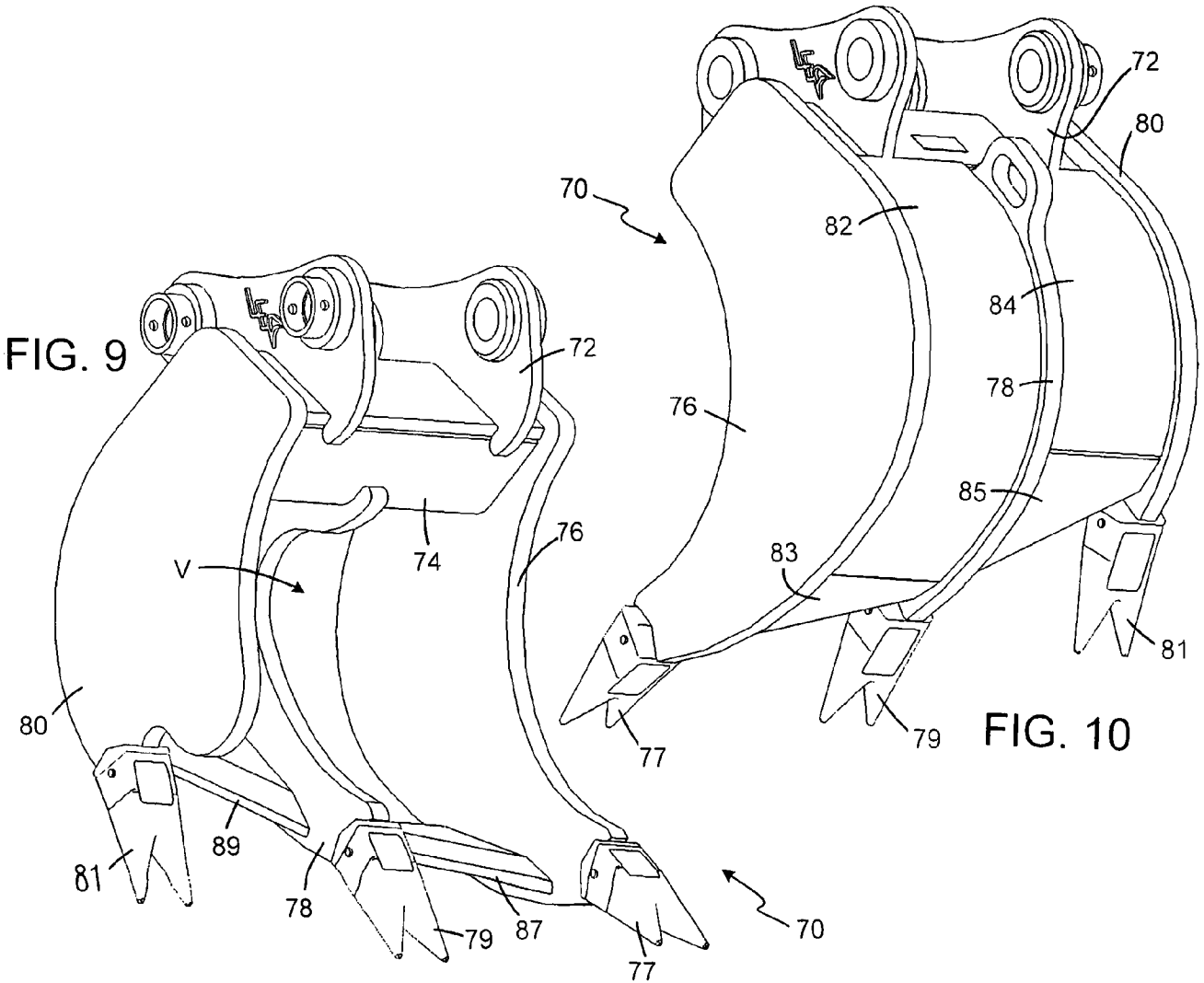
FIG. 9 is a left front prospective view of still another implementation of a multi-shank ripper excavation tool of the disclosure formed with a bucket structure for receiving and removing excavated substrate during ripping.
FIG. 10 is a right rear prospective view of the multi-shank ripper excavation tool of FIG. 9.
Figure 11:
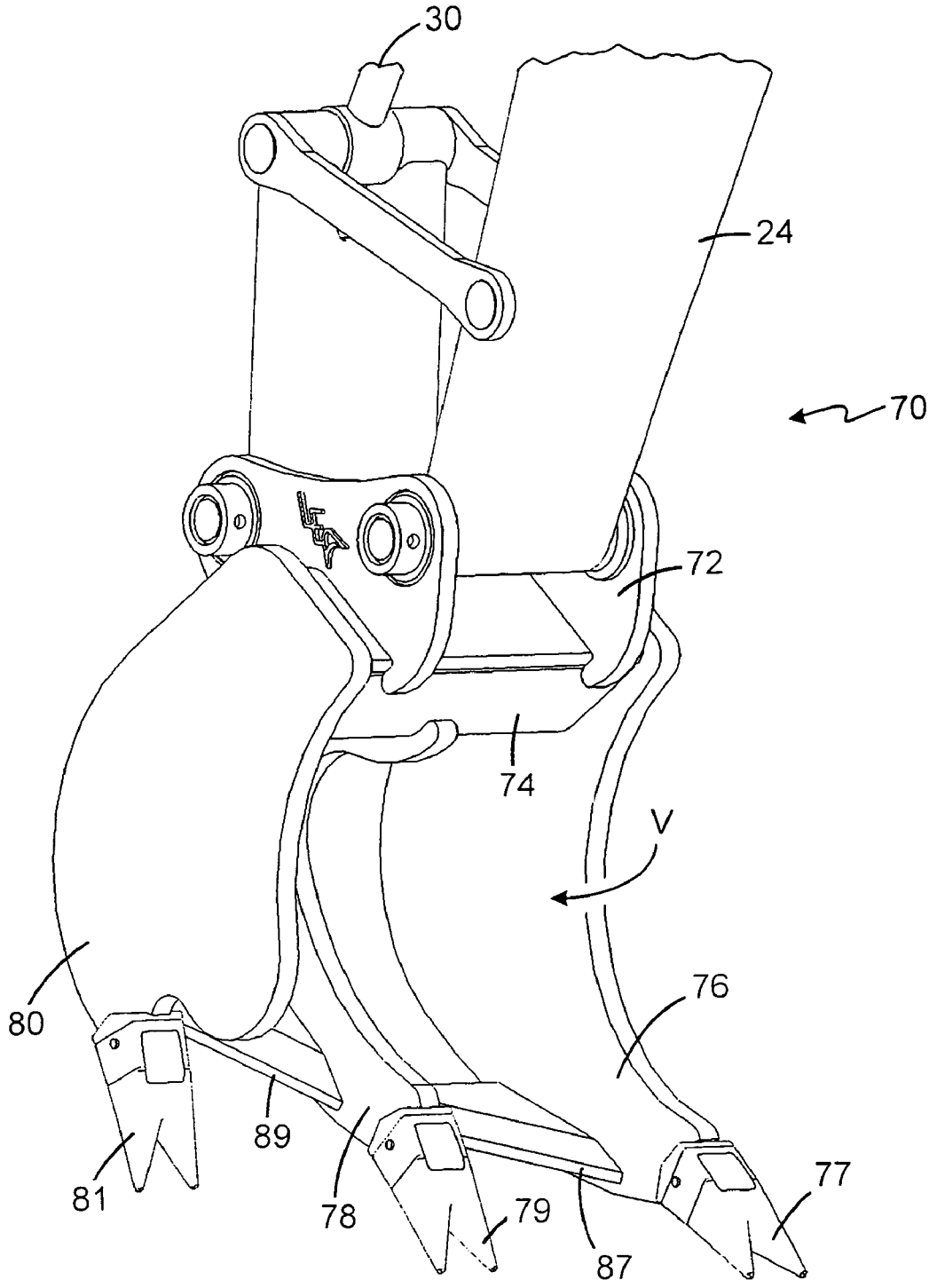
FIG. 11 is a left front prospective view of the multi-shank ripper excavation tool of FIG. 9, mounted to a dipper stick.
Figure 12:
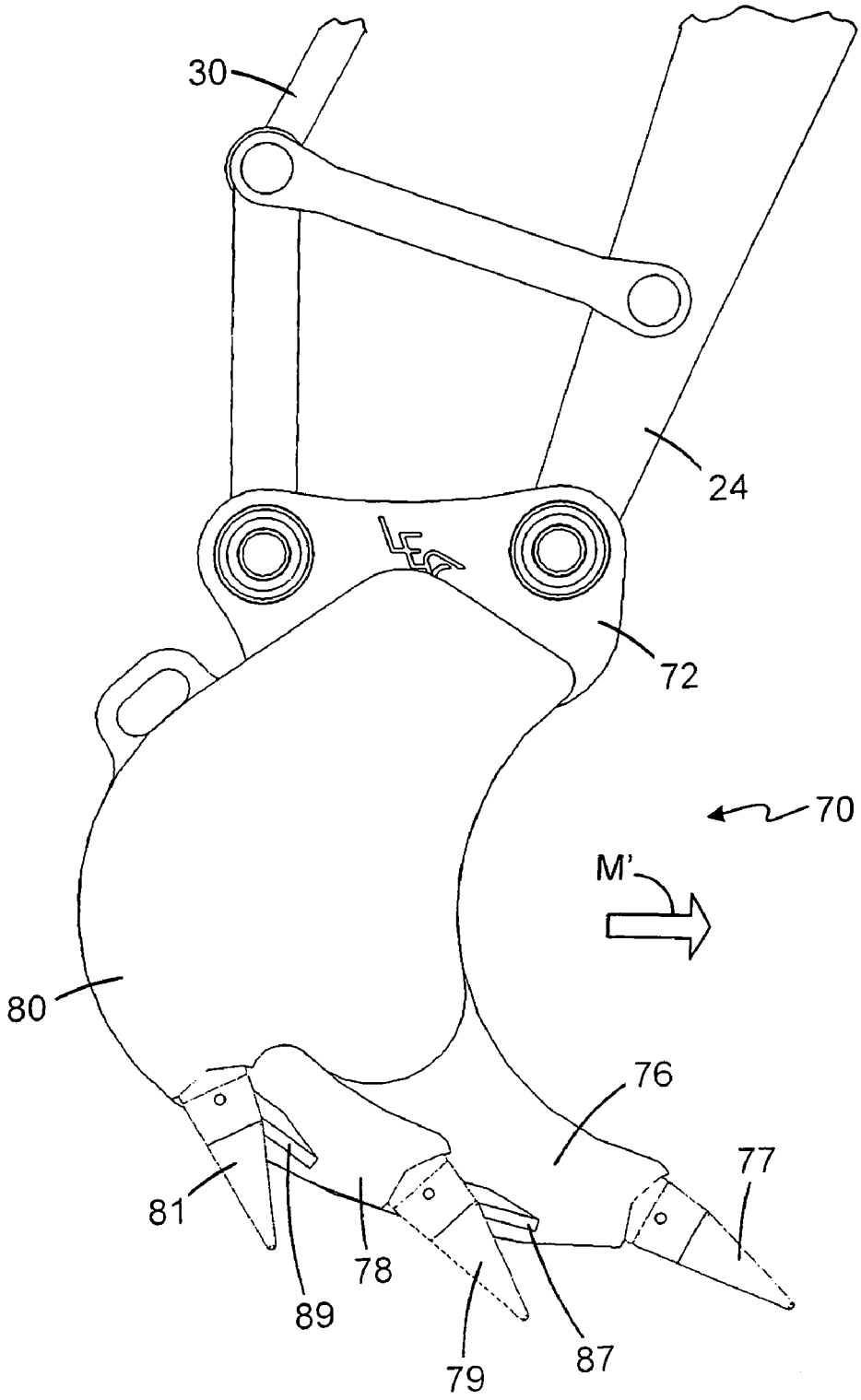
FIG. 12 is a side view of the multi-shank ripper excavation tool of FIG. 11.
Figure 13:
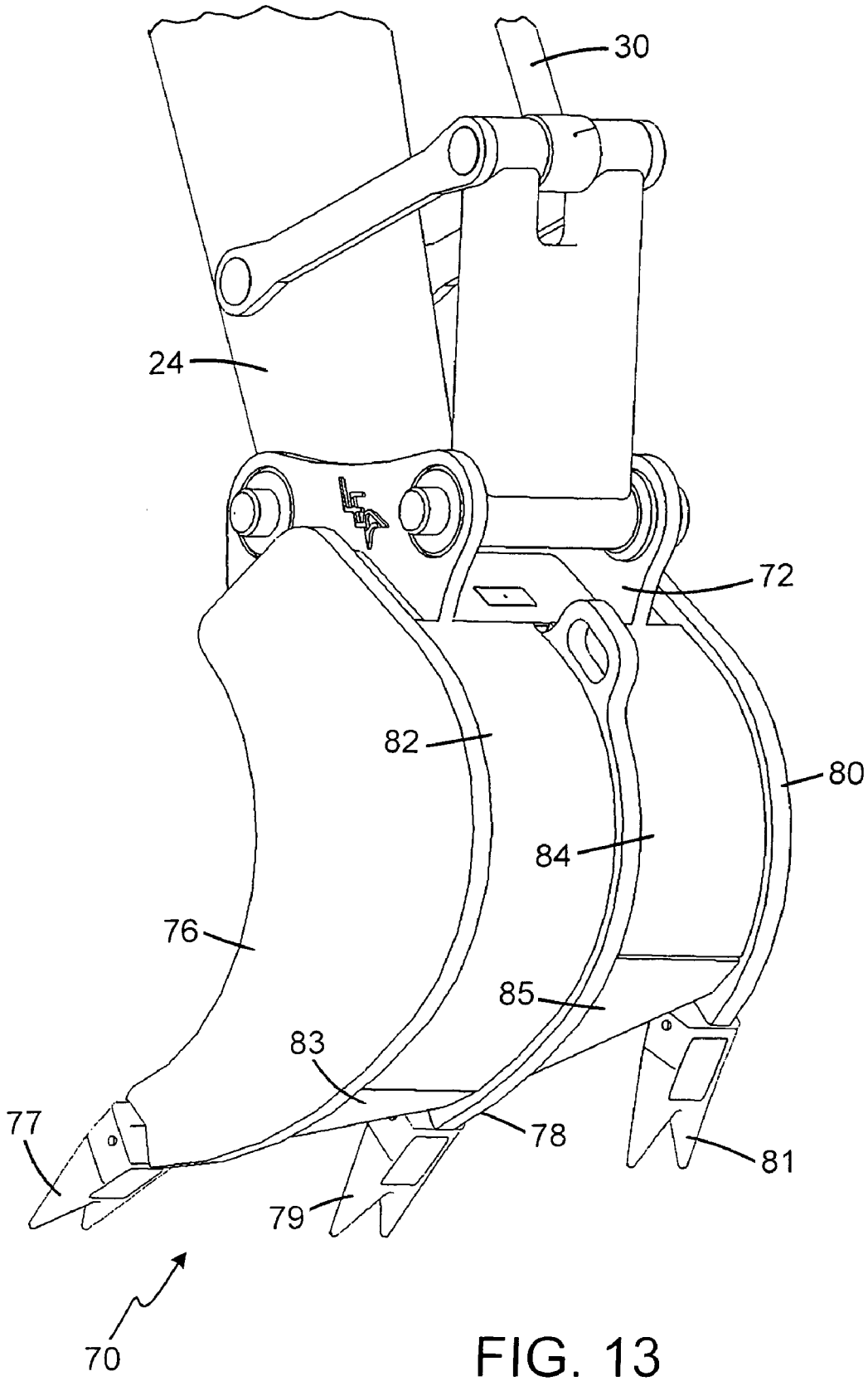
FIG. 13 is right rear prospective view of the multi-shank ripper excavation tool of FIG. 11.
Figure 14:
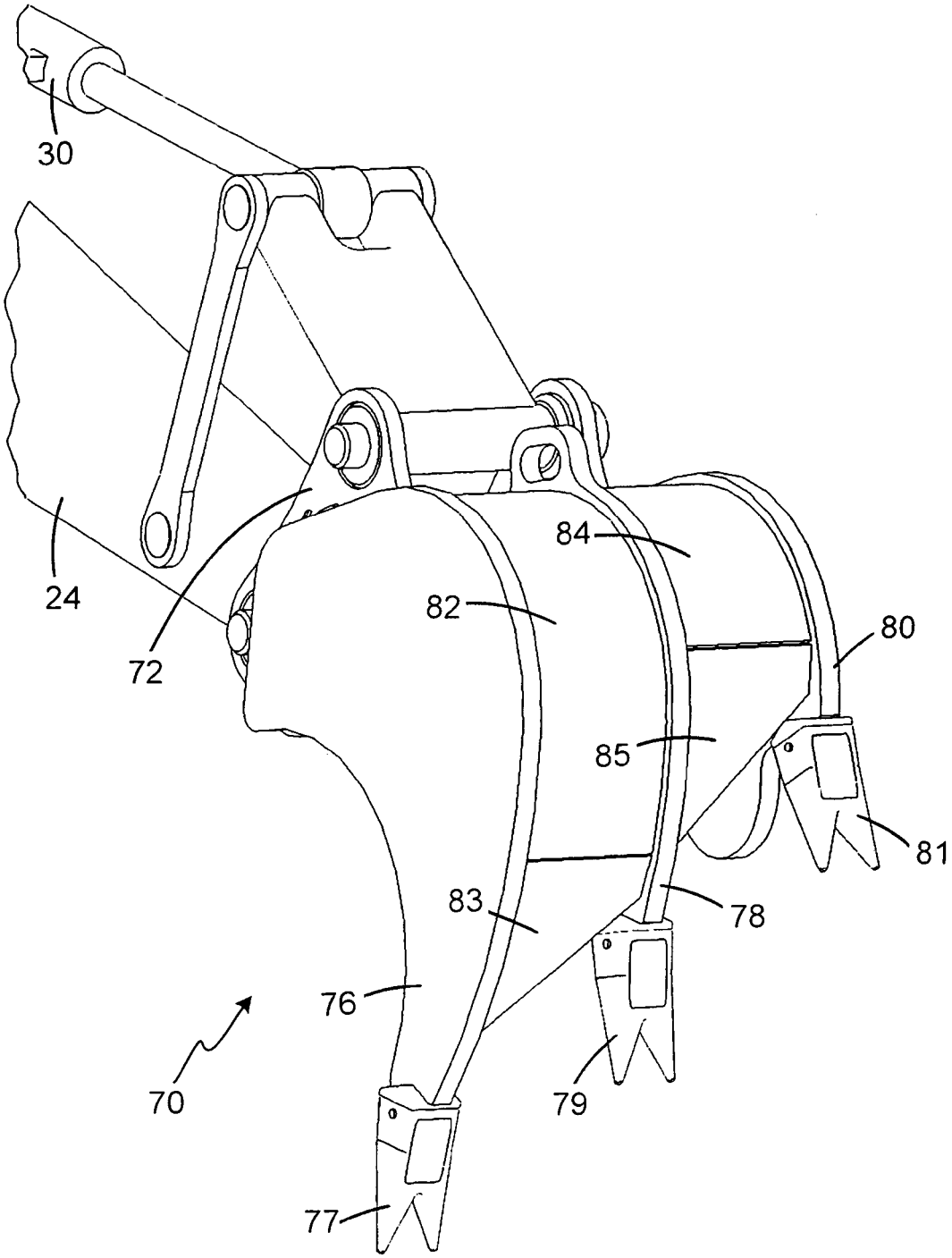
FIG. 14 is another right rear prospective view of the multi-shank ripper excavation tool of FIG. 11.

Referring now to FIGS. 6 through 8, in another implementation of the ripper excavation tools of the disclosure, a multi-shank ripper excavation tool 50 is constructed for pivotal connection directly to the outboard end of the dipper stick 24 of the hydraulic excavator 10 (FIG. 1) by means of a conventional coupling mechanism 52.

The multi-shank ripper excavation tool 50 includes a body portion 54 to which the lower side of the conventional coupler mechanism 52 is joined. Multiple shanks, e.g. as least two shanks, and preferably at least three shanks, as shown, or more, are all mounted directly to the body portion 54. Each ripper shank 56, 58, 60 terminates in a ripper tooth 57, 59, 61, respectively, attached to, or integrally formed at, the outboard end of the associated shank. As above, the ripper teeth 57, 59, 61 are spaced from each other generally along the axis, A' (FIG. 8) and angularly about the axis, A'.

The multi-shank ripper excavation tools 12, 50 of these implementations of the disclosure offer significant advantages over other ripper-type tools, including ripper-and-bucket type tools. For example, the multi-shank ripper excavation tools 12, 50 provide more visibility, as the operator can look through the shanks (36, 38 40; 56, 58, 60) or tines of the ripper to see what he is doing, which is important around utilities and other obstacles. Also, the distance from the dipper stick pivot to the tips of the ripper teeth (37, 39, 41; 57, 59, 61) can be at least about 20% less that the tip radius dimension of a conventional bucket for a given machine. The shorter length decreases the moment arm and thus increases the tip forces. During the ripping function, since there is no leading lip, there is very little drag through the ripped material, and all of the forces are concentrated on the teeth tips. The power or forces generated by the multi-shank ripper excavation tools 12, 50 are substantially higher, which amplifies the breakout forces. In fact, the forces generated by the multi-shank ripper excavation tools 12, 50 can be high enough to actually break different forms of solid rock and allow the ripper teeth to rip out rocks imbedded in fragmented rock. The depth of the cut is also deeper since there is no conventional bucket bottom, and the pieces of the dislodged material flow through the shanks or tines, thus allowing the shanks to engage the unripped material below the thick debris layer. The shanks of the multi-shank ripper excavation tools 12, 50 flip the loosened material out of the way, so the loosened material does not accumulate and the trench ripping operation can continue until complete. The area can then be rapidly cleaned up afterward with a conventional bucket. Attachments only have to be switched once, rather than repeatedly, e.g. as with conventional ripping tools. The operator may also use the tool to simply till the soil in order to expose buried rocks or loosen the ground.

Referring next to FIGS. 9 through 14, in yet another implementation of the ripper excavation tools of the disclosure, a multi-shank ripper-and-bucket excavation tool 70 is constructed for pivotal connection directly to the outboard end of the dipper stick 24 of the hydraulic excavator 10 (FIG. 1) by means of a conventional coupling mechanism 72, e.g. as shown in FIGS. 11, 12, 13 and 14. Alternatively, the multi-shank ripper-and-bucket excavation tool 70 can be mounted to the outboard end of the dipper stick 24 by means of a quick connect coupler mechanism, e.g. as shown in FIGS. 2, 3, 4, and 5.

The multi-shank ripper-and-bucket excavation tool 70 includes a body portion 74 to which the lower side of the conventional coupler mechanism 72 is joined. Multiple shanks, e.g. as least two shanks, and preferably at least three shanks, as shown, or more, are all mounted directly to the body portion 74. As described above, each ripper shank 76, 78, 80 terminates in a ripper tooth 77, 79, 81, respectively, attached to, or integrally formed at, the outboard end of the associated shank. As above, the ripper teeth 77, 79, 81 are spaced from each other generally along the axis and angularly about the axis. Plates 82, 83 and 84, 85 are disposed to span the open regions between adjacent shanks 76, 78 and 78, 80, respectively, to define a bucket volume, V, for collection of material as it is broken from the substrate during ripping motion. Leading edges 87, 89, formed along the front portions of plates 83, 85 to further facilitate some digging and loading ability, are generally angled in a direction of the angular spacing of the ripper teeth 77, 79, 81. Also, as best seen in the front views of FIGS. 9 and 13, the intermediate shank 78 is arcuate in shape and relatively thin in the direction of ripping motion (arrow M', FIG. 12), thereby increasing the effective bucket volume of the multi-shank ripper-and-bucket excavation tool 70.

Figure 15:
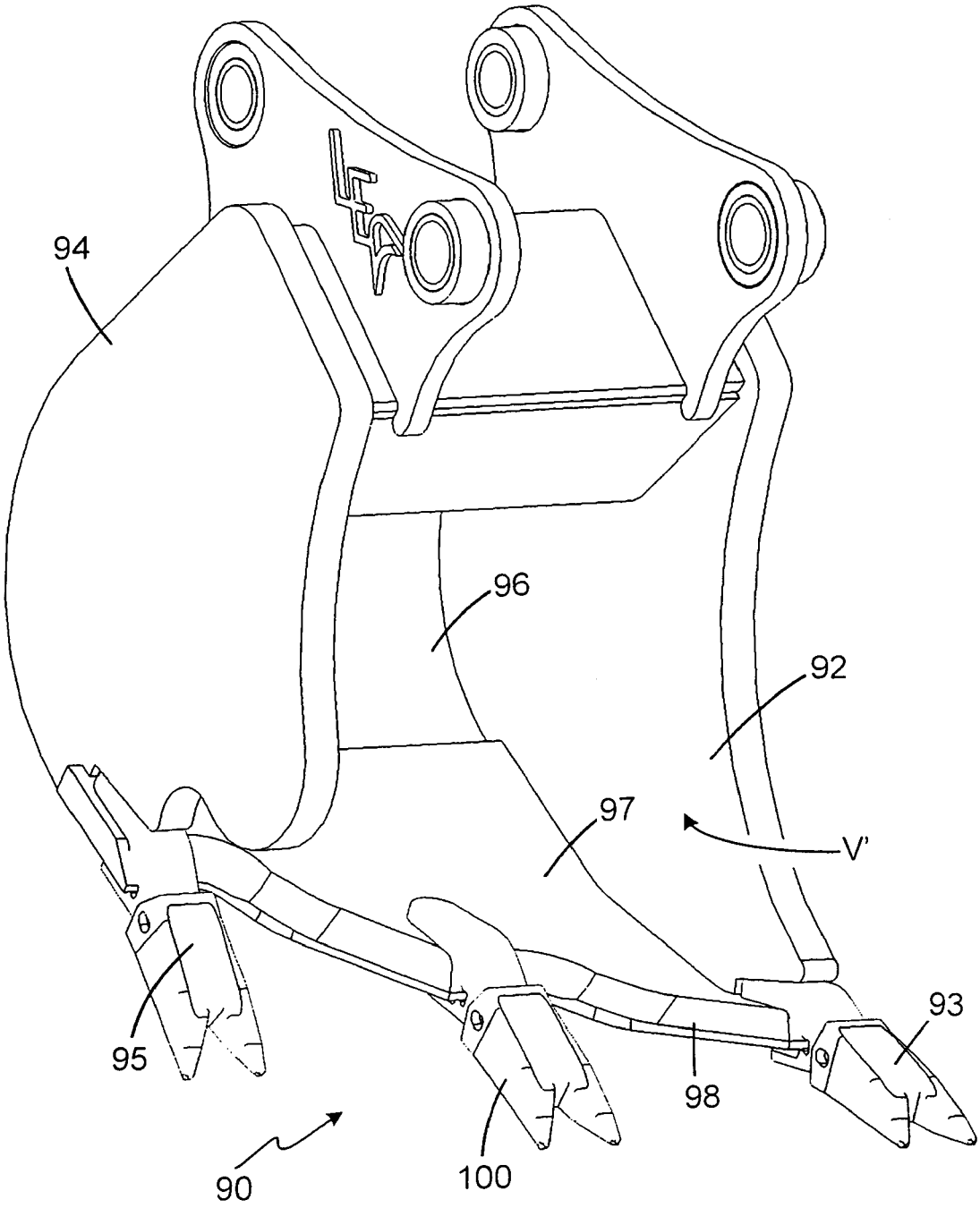
FIG. 15 is a left front prospective view of yet another implementation of a multi-shank ripper excavation tool of the disclosure, with a bucket structure, formed by two shanks, for receiving and removing excavated substrate during ripping.

Referring to FIG. 15, in another implementation, to further increase the effective bucket volume and facilitate digging and loading, multi-shank ripper-and-bucket excavation tool 90 of the disclosure is formed with only the two outboard shanks 92, 94. Plates 96, 97 are disposed to span the open regions between shanks 92, 94, respectively, to define the bucket volume, V', for collection of material as it is broken from the substrate during ripping motion. Again as described above, each ripper shank 92, 94 terminates in a ripper tooth 93, 95, respectively, attached to, or integrally formed at, the outboard end of the associated shanks 92, 94. A leading edge 98, formed along the front portion of plate 97 to further facilitate some digging and loading ability, is generally angled in a direction of the angular spacing of the ripper teeth 93, 95. A third ripper tooth 100 is mounted intermediate to ripper tooth 93 and ripper tooth 95 and mounted to the leading edge 98. As above, the ripper teeth 93, 95, 100 are spaced from each other generally along the axis and angularly about the axis.

Referring to FIG. 16, is still another implementation, a multi-shank ripper excavation tool 110 is similar in construction and concept to the ripper excavation tools described above. In this implementation, the multi-shank ripper rake excavation tool 110 has five shanks 112, 114, 116, 118, 120 mounted to a body 122, and with ripper teeth that are integral with the associated shank. As above, the ripper teeth are spaced from each other generally along the axis and angularly about the axis.

Figure 17:
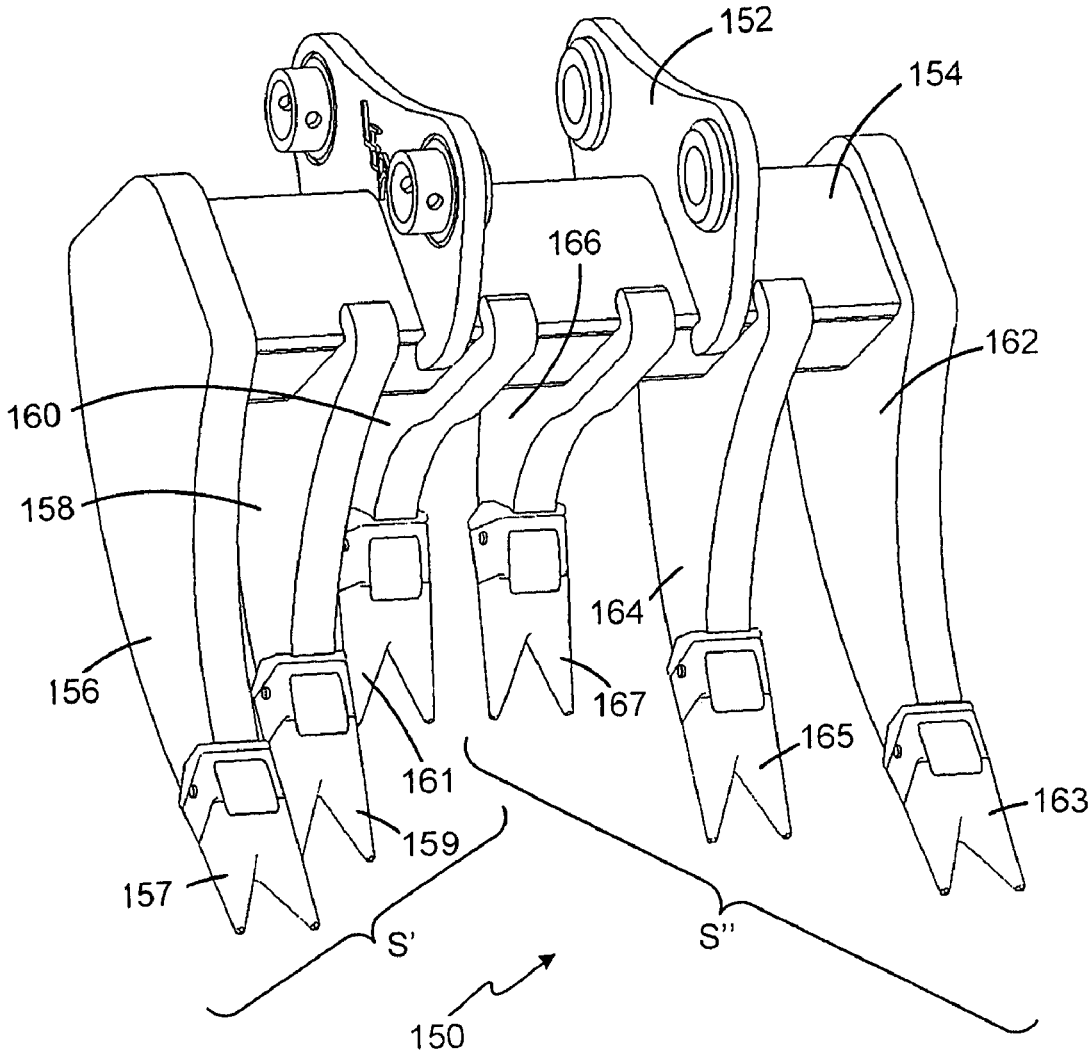
FIG. 17 is a left front prospective view of a further implementation of the multi-shank ripper excavation tool of the disclosure in a form having two sets of multiple shanks mounted to the body.

Referring now to FIG. 17, in yet another implementation, a multi-shank ripper excavation tool 150 has multiple, i.e. two, sets, S', S", of multiple shanks 156, 158, 160 and 162, 164, 166 arrayed according to the disclosure. The multi-shank ripper excavation tool 150 is constructed for pivotal connection directly to the outboard end of the dipper stick 24 of the hydraulic excavator 10 (FIG. 1) by means of a conventional coupling mechanism 152. The multi-shank ripper excavation tool 150 includes a body portion 154 to which the lower side of the conventional coupler mechanism 152 is joined. Two sets, S', S", of multiple shanks, e.g. as least two shanks, and preferably at least three shanks, as shown, or more, per set are all mounted directly to the body portion 154. Each ripper shank 156, 158, 160 and 162, 164, 166 terminates in a ripper tooth 157, 159, 161 and 163, 165, 167, respectively, attached to, or integrally formed at, the outboard end of the associated shank. As described above, and in particular with reference to FIGS. 6 through 8, the ripper teeth 157, 159, 161 and 163, 165, 167 are spaced from each other generally along the axis, A' (FIG. 8) and angularly about the axis, A'.

Figure 18:
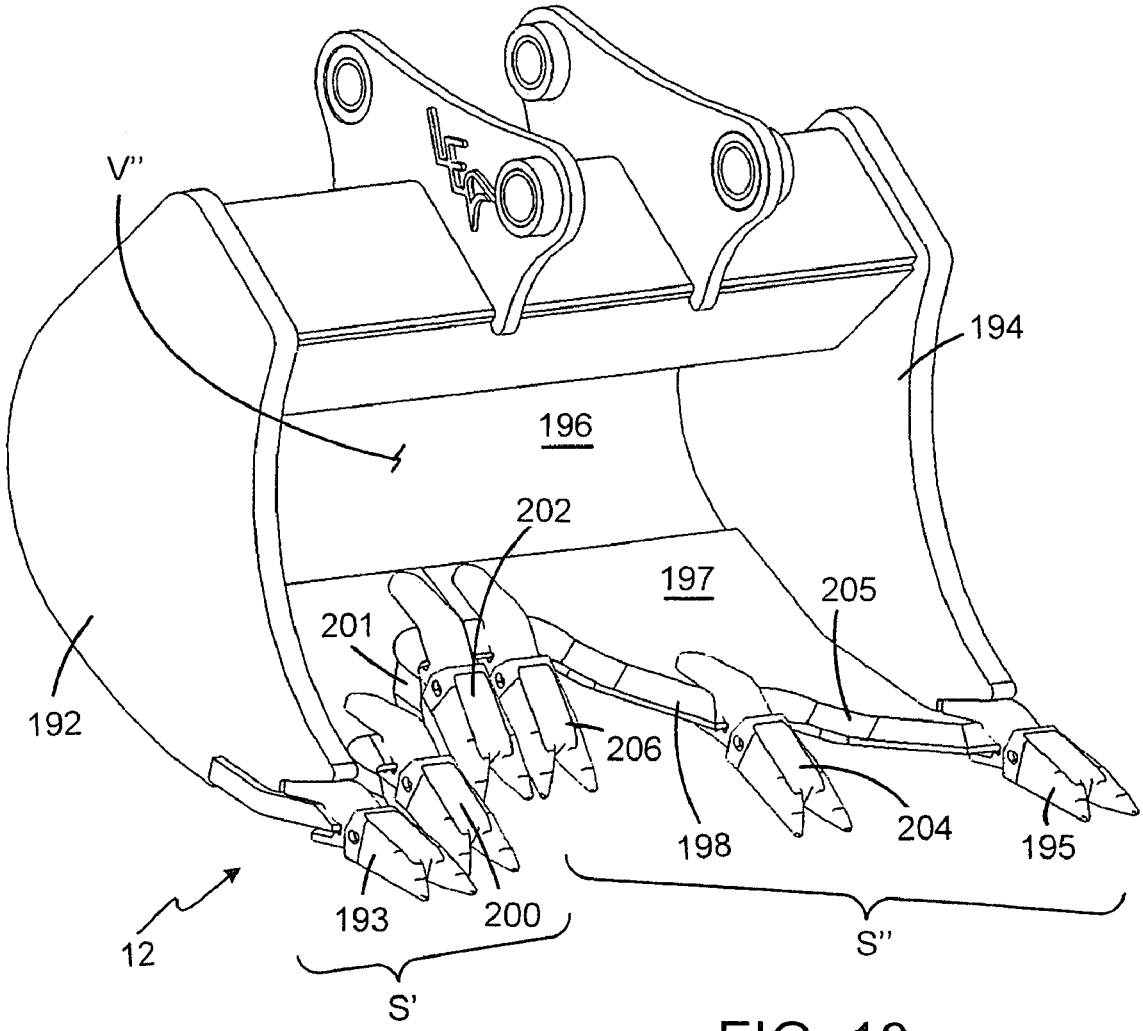
FIG. 18 is a left front prospective view of a still further implementation of a multi-shank ripper-and-bucket excavation tool of the disclosure in a form having multiple sets of ripper teeth.

Referring next to FIG. 18, in another implementation, to further increase the effective bucket volume and facilitate digging and loading, a multi-shank ripper-and-bucket excavation tool 190 of the disclosure is formed with only the two outboard shanks 192, 194. Plates 196, 197 are disposed to span the open regions between shanks 192, 194, respectively, to define the bucket volume, V", for collection of material as it is broken from the substrate during ripping motion. Again as described above, each ripper shank 192, 194 terminates in a ripper tooth 193, 195, respectively, attached to, or integrally formed at, the outboard end of the associated shank 192, 194. Leading edge 198 is formed along the front portion of plate 197 in a V-shape configuration to further facilitate some digging and loading ability. Each arm of the V-shape is generally angled in a direction of the angular spacing of a first set of ripper teeth, S', including ripper tooth 193 with intermediate teeth 200, 202 mounted to the arm 201 of leading edge 198, and the set of ripper teeth, S", including ripper tooth 195 with intermediate teeth 204, 206 mounted to the arm 205 of leading edge 198. As above, the ripper teeth 193, 200, 202 and the ripper teeth 195, 204, 206, respectively, are spaced from each other generally along the axis and angularly about the axis.

Operation of the multi-shank ripper excavation tools of the disclosure will now be described with particular reference to FIG. 1, and also to FIGS. 2 through 5. In the case of a generally horizontal substrate, S, the tool 12 is pivoted all the way back at the end of the dipper stick 24 and extended out as far forward of the chassis 14 as possible. The tool 12 is then lowered until the leading ripper tooth, typically tooth 37 on shank 36, engages the substrate, S. The multi-shank ripper excavation tool 12 is then drawn downward and, in ripping motion, toward the chassis 14 to cause the ripper tooth 37 to penetrate the surface of the substrate, S, and to begin ripping the substrate. Simultaneously, the multi-shank ripper excavation tool 12 is pivoted forward, so that as each ripper tooth, in succession, breaks through the surface of the substrate S, the ripper tooth following immediately to the rearward thereof, in turn, contacts and begins breaking through the surface of the substrate, S.

In a ripping operation employing a multi-shank ripper excavation tool of the disclosure, after the first ripper tooth 37 breaks out material, the machine nosedives, then the second ripper tooth 39 engages the substrate, and this energy is transferred to the second ripper tooth ripping function. After the second ripper tooth 39 breaks free, the same effect reoccurs and on to subsequent teeth 41, etc. Since this machine momentum effect is so powerful, the rear teeth 39, 41 are able to rip more aggressively than the front tooth 37. Positioning the ripper tip arc center, A, higher and forward of the dipper pivot, H, utilizes this momentum effect.

Since, as described above, no two ripper teeth are in alignment, when the multi-shank ripper excavation tool 12 is rolled, each tooth 37, 39, 41 engages separately, so that each tooth fractures the groove cut by the preceding tooth. Since the tool 12 always has only one tooth engaging the substrate at a time, the full cylinder force is exerted on the single tooth. The castle top shape groove cut by a leading ripper tooth 37 also facilitates the fracturing process of the following ripper tooth 39, 41, etc. The result is a relatively flat trench bottom cut, since the ripper tooth tips all lie on a constant radius (arc, R) with a center of rotation, A, lying close to the hydraulic excavator dipper stick pivot, H. The tool 12 is rolled as the stick is being moved so that all the ripper teeth 37, 39, 41 engage the substrate in sequence. The result is a ripping motion that is very powerful, very fast and very effective, but also very smooth and easy on the excavator machine 10 and on the operator. As one tooth breaks free, the next tooth is there to pick up the load. The tool 12 is suitable for excavation of a wide range of tough materials, such as ripping frozen ground, coral, sandstone, limestone, caliches, and even ripping stumps. The ripping action is so powerful that it is very important for the operator to take safety precautions against projected objects, especially when ripping brittle material such as frost and certain types of rock. When working with these types of materials, hard hats, safety glasses, and an excavator steel mesh windshield guard are all necessary equipment.

Figure 19:
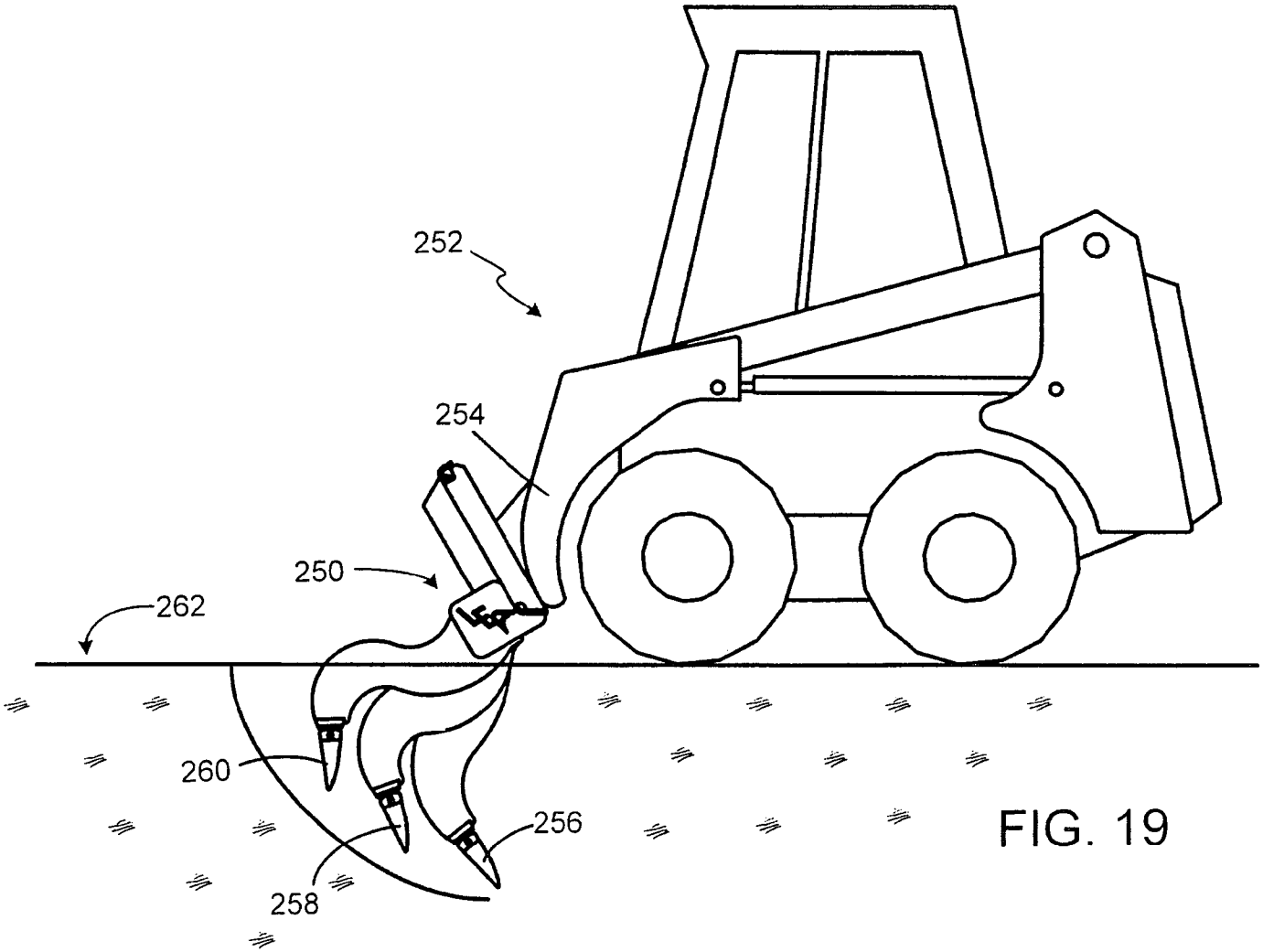
FIG. 19 is a prospective view of a skid steer loader fitted with another implementation of a multi-shank ripper excavation tool of the present disclosure.
Figure 20:
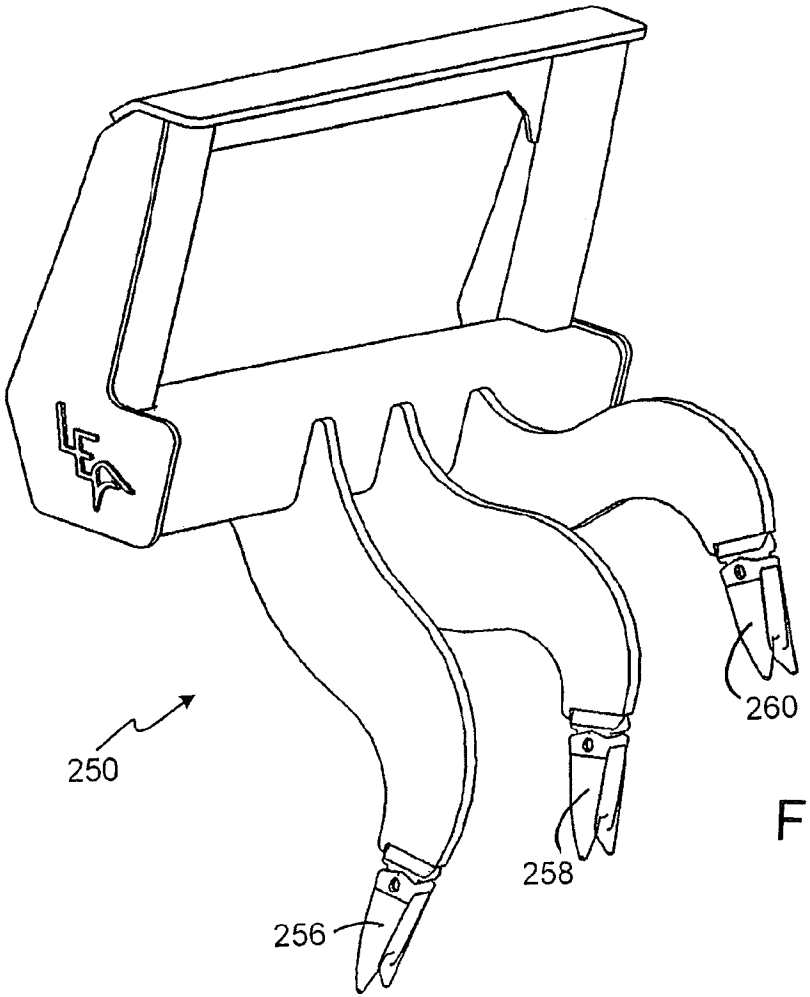
FIG. 20 is a left front prospective view of the multi-shank ripper excavation tool of FIG. 19.

Referring to FIGS. 19 and 20, in another implementation, a multi-shank ripper excavation tool 250 is mounted to the arm, i.e. a boom arm 252, of a skid steer loader 254 (e.g. 45 hp or larger), e.g. for ripping rock, frost, asphalt, hard packed surfaces or even stumps. The multi-shank ripper excavation tool 250 is constructed of thick, tough AR400 steel and may be adapted to fit any skid steer loader equipped with an SAE standard quick coupler.

The skid steer loader multi-shank ripper excavation tool 250 functions in a manner similar to that described above with reference to a trencher, but uses the skid steer loader rolling action for its ripping motion. Also as described above, the staggered ripper teeth 256, 258, 260 (three teeth are shown, but four to six teeth may be employed) fracture the substrate in sequential order. No two ripper teeth are in alignment with each other, so the maximum breakout force is applied sequentially to each tooth. As a result, an operator can rip up to 24 inches deep while simultaneously being able to rip the sides of the trench from 18 inches up to 40 inches wide. The multi-shank ripper excavation tool 250 is several times more productive than a hammer for most applications, and should extend the life of the machine.

Operation of the multi-shank ripper excavation tool 250 mounted on a skid steer loader will now be described, with reference to FIGS. 19 and 20. Starting at one end of the trench or patch to be ripped, the first tine is positioned in a near-vertical position. Down pressure is applied on the tool 250 using the boom cylinder function. While moving the machine 252, a combination of rearward tractive effort and bucket cylinder rolling functions is used while providing boom cylinder down pressure. The bucket cylinder action provides the greatest force while the loader travels. Since no two teeth are in alignment, when the multi-shank ripper excavation tool 250 is rolled, each tooth 256, 258, 260 engages separately so that each tooth fractures the groove cut by the preceding tooth. The multi-shank ripper excavation tool 250 is rolled completely as the loader 252 moves so that all of the teeth are engaged in turn with the substrate 262, thus causing a very powerful, fast and effective ripping motion that is easy on the machine and operator.

The ripping action is powerful, and it is very important that the operator take safety precautions against projected objects, especially with brittle materials such as frost and certain rock. For this type of material, hard hats, safety glasses and an excavator steel mesh windshield guard are all necessary requirements.

A number of implementations of the disclosure have been described. Nevertheless, it will be understood that various modifications may be made without departing from the spirit and scope of the disclosure. For example, in pin-on versions of multi-shank ripper excavation tools of the disclosure (i.e. tools without a quick connect coupler, e.g. as shown in FIG. 6 et seq.), a body tubular cross brace portion connected to the center shank may separate the two outboard shanks, which would then pick up the linkage mounting collars. The center shank might then be the last engaging ripper tooth, as opposed to being the second engaging ripper tooth, e.g. as described above. Also, the nosepiece adapters welded to the shank tips for mounting the ripper teeth may be exchanged for conventional tooth adapters, if the shanks are cut to form around the adapters. Conventional crawler tractor ripper teeth may also be used, or the multi-shank ripper excavation tool may have integral tips or teeth. Also, the arc extending through the tip of each ripper tooth may be centered at, near, or above the dipper pivot point. Where multiple sets of shanks and/or ripper teeth are employed, respective sets of shanks and/or ripper teeth may be arrayed in mirror configuration, e.g. as shown in FIGS. 17 and 18, or respective sets of shanks and/or ripper teeth may be arrayed in side-by-side (glide) transformation or in another suitable arrangements.

Figure 21:
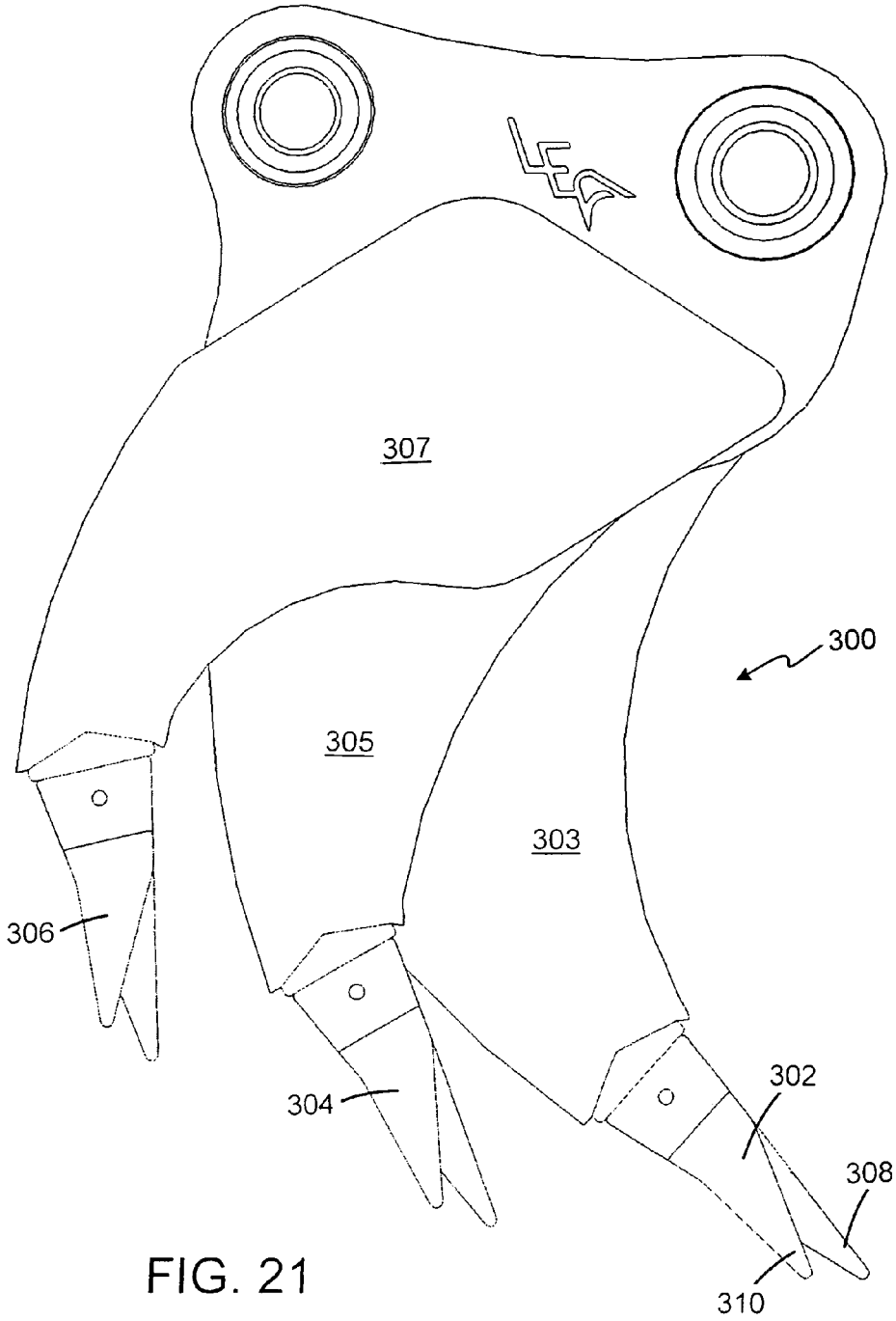
FIG. 21 is a side view of the multi-shank ripper excavation tool of another implementation of the disclosure equipped with ripper teeth having two tiger points.
Figure 22:
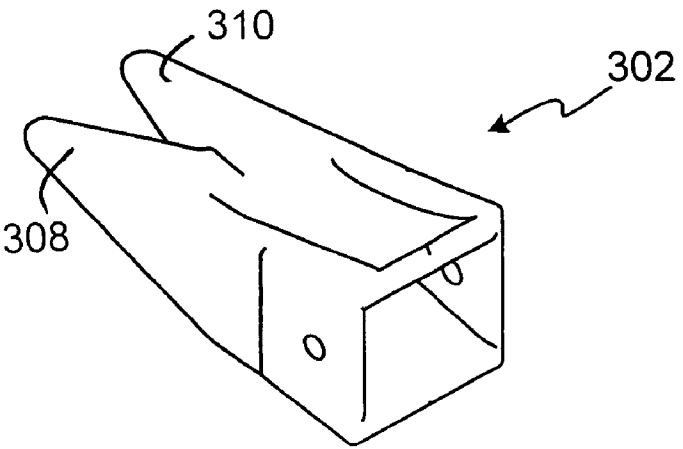
Figure 25:
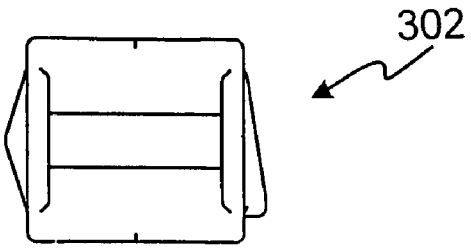
FIGS. 23, 24 and 25 are top plan, side and rear views, respectively, of the ripper tooth of FIG. 22.
Figure 23:
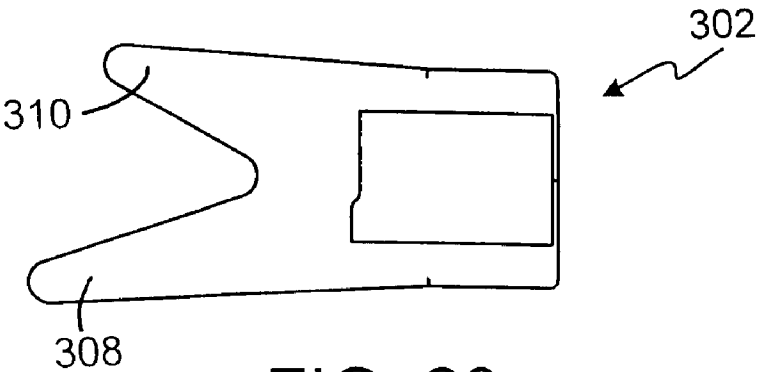
Figure 24:
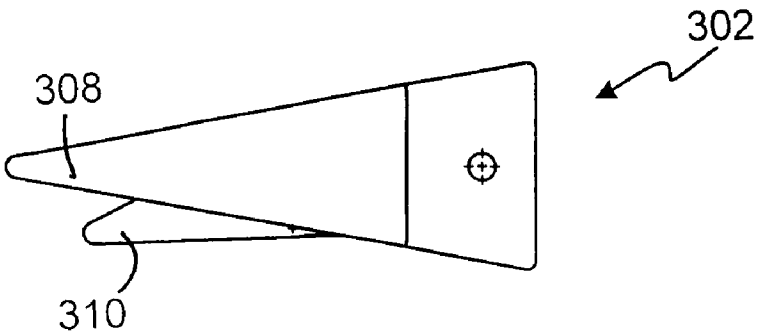

Also, referring to FIG. 21, a multi-shank ripper-and-bucket excavation tool 300 may be provided with ripper teeth 302, 304, 306 having twin or double tiger points 308, 310 disposed for sequential engagement with the substrate. For example, the individual tiger teeth 308, 310 of each ripper tooth 302, 304, 306 may be disposed in an array corresponding to the arrangement of the shanks 303, 305, 307. In a preferred implementation, seen in FIG. 21, the twin or double tiger points 308, 310 of each ripper tooth 302, 304, 306 are laterally spaced apart from each other, and the twin or double tiger points 308, 310 of each ripper tooth 302, 304, 306 are angularly offset from each other in the direction of substrate ripping motion.

Accordingly, other implementations are within the scope of the following claims.

What is claimed is:

1. A multi-shank ripper excavation tool for use mounted to an arm of an excavation machine, said multi-shank excavation ripper tool comprising:

a body mounted for rotation from the arm, and at least one set of multiple shanks mounted to the body, each shank of said at least one set of multiple shanks being disposed generally perpendicular to an axis of rotation of said multi-shank ripper excavation tool relative to the arm, and each said shank of said at least one set of multiple shanks comprising a ripper tooth disposed at a forward end thereof for ripping engagement with a substrate, said set of multiple shanks comprising at least:

a first shank comprising a first ripper tooth disposed at a forward end thereof for ripping engagement with the substrate, a second shank comprising a second ripper tooth disposed at a forward end thereof for ripping engagement with the substrate, said second shank being laterally spaced from said first shank along the axis of rotation of said multi-shank ripper excavation tool relative to the arm, and said second ripper tooth being angularly spaced from said first ripper tooth in a direction of substrate ripping motion, and each said ripper tooth having a ripper tooth tip and being disposed at a predetermined angle to a tangent to an arc of rotation extending generally through its said ripper tooth tip with an arc center at an axis of rotation of said ripper tooth tip and said first ripper tooth and said second ripper tooth being non-parallel.

2. The multi-shank ripper excavation tool of claim 1, wherein said first ripper tooth is angularly advanced relative to said second ripper tooth in a direction of substrate ripping motion, whereby said first ripper tooth is engaged for ripping the substrate before said second ripper tooth is engaged for ripping the substrate.

3. The multi-shank ripper excavation tool of claim 1, said set of multiple shanks further comprises at least:

a third shank comprising a third ripper tooth disposed at a forward end thereof for ripping engagement with a substrate, said third shank being laterally spaced from said first shank and from said second shank along the axis of rotation of said multi-shank ripper excavation tool relative to the arm, and said third ripper tooth being angularly spaced from said first ripper tooth and from said second ripper tooth in a direction of ripping motion, said third ripper tooth being non-parallel with said first ripper tooth and said second ripper tooth, and a set of ripper tooth tips of said first ripper tooth, said second ripper tooth and said third ripper tooth being non-planar.

4. The multi-shank ripper excavation tool of claim 3, wherein said first ripper tooth is angularly advanced relative to said second ripper tooth in a direction of ripper rotation and said second ripper tooth is angularly advanced relative to said third ripper tooth in a direction of ripping rotation, whereby said first ripper tooth is engaged for ripping the substrate before said second ripper tooth and said third ripper tooth are engaged for ripping the substrate, and said second ripper tooth is engaged for ripping the substrate before said third ripper tooth is engaged for ripping the substrate.

5. The multi-shank ripper excavation tool of claim 1, said set of multiple shanks further comprises additional shanks, each comprising a ripper tooth disposed at a forward end thereof for ripping engagement with a substrate, each said additional shank being laterally spaced from each other shank along the axis of rotation of said multi-shank ripper excavation tool relative to the arm, and the said ripper tooth of each said additional shank being angularly spaced from the said ripper tooth of each other of said additional shanks in a direction of ripping motion.

6. The multi-shank ripper excavation tool of claim 1, where said ripper tooth is replaceably mounted to said shank.

7. The multi-shank ripper excavation tool of claim 1, wherein said ripper tooth is integral with said shank.

8. The multi-shank ripper excavation tool of claim 1, wherein said body portion comprises a body upper portion and a body tubular cross brace portion.

9. The multi-shank ripper excavation tool of claim 1, wherein each said ripper tooth comprises a nosepiece adapter.

10. The multi-shank ripper excavation tool of claim 1, wherein said arc center is located near and generally above and forward of a dipper pivot rotation center.

11. The multi-shank ripper excavation tool of claim 1, wherein said predetermined angle is between about 20° and about 50° from the tangent.

12. The multi-shank ripper excavation tool of claim 1, wherein each said ripper tooth has a top cutting surface and a bottom cutting surface.

13. The multi-shank ripper excavation tool of claim 12, wherein each said top cutting surface is disposed at an angle of between about 35° and about 70° from the tangent.

14. The multi-shank ripper excavation tool of claim 1, wherein said ripping teeth are selected from the group consisting of: tiger points, twin or double tiger points, and crawler tractor ripping teeth.

15. The multi-shank ripper excavation tool of claim 1, wherein one or more of the ripping teeth comprises twin or double tiger points, and the twin or double tiger points of the one or more ripping teeth are spaced apart laterally and spaced apart angularly in a direction of ripping motion.

16. The multi-shank ripper excavation tool of claim 1, wherein said at least one set of multiple shanks comprises at least two sets of multiple shanks.

17. The multi-shank ripper excavation tool of claim 16, wherein said two sets of multiple shanks are arrayed in a mirror configuration.

18. The multi-shank ripper excavation tool of claim 16, wherein said two sets of multiple shanks are arrayed in a side-by-side transformation.

19. The multi-shank ripper excavation tool of claim 1, wherein the arm is a dipper arm.

20. The multi-shank ripper excavation tool of claim 1, wherein the arm is a boom arm.

21. The multi-shank ripper excavation tool of claim 1, wherein the arc of rotation extending generally through the ripper tooth tip of each of said first ripper tooth and said second ripper tooth has a predetermined, substantially common radius.

22. The multi-shank ripper excavation tool of claim 1, claim 2, claim 3, claim 4, or claim 5, further comprising one or more plate members mounted to span a region between two or more said shanks of said set of multiple shanks, rearward of said ripper teeth in a direction of ripping motion and defining, with said two or more of said shanks, a bucket volume for receiving material ripped from the substrate during ripping motion.

23. The multi-shank ripper excavation tool of claim 22, wherein said one or more plate members define one or more leading edges angled in a direction of angular spacing of said ripper teeth.

24. The multi-shank ripper excavation tool of claim 1 or claim 5 wherein said angular spacing between adjacent said ripper teeth in a direction of ripping motion is between about 15° and about 30°.

25. The multi-shank ripper excavation tool of claim 24, wherein angular spacing between adjacent said ripper teeth in a direction of ripping motion is about 20°.

26. A multi-shank ripper excavation tool for use mounted to an arm of an excavation machine, said multi-shank excavation ripper tool comprising:

a body mounted for rotation from the arm, and at least one set of multiple shanks mounted to the body, each shank of said at least one set of multiple shanks being disposed generally perpendicular to an axis of rotation of said multi-shank ripper excavation tool relative to the arm, and each said shank of said at least one set of multiple shanks comprising a ripper tooth disposed at a forward end thereof for ripping engagement with a substrate, said at least one set of multiple shanks comprising at least:

a first shank comprising a first ripper tooth disposed at a forward end thereof for ripping engagement with the substrate, a second shank comprising a second ripper tooth disposed at a forward end thereof for ripping engagement with the substrate, said second shank being laterally spaced from said first shank along the axis of rotation of said multi-shank ripper excavation tool relative to the arm, and said second ripper tooth being angularly spaced from said first ripper tooth in a direction of substrate ripping motion, and each said ripper tooth having a ripper tooth tip and being disposed at a predetermined angle to a tangent to an arc of rotation extending generally through its said ripper tooth tip, with an arc center at an axis of rotation of said ripper tooth tip and said first ripper tooth and said second ripper tooth being non-parallel, and said multi-shank ripper excavation tool further comprising one or more plate members mounted to span a region between two or more said shanks of said set of multiple shanks, rearward of said ripper teeth in a direction of ripping motion and defining, with said two or more said shanks, a bucket volume for receiving material ripped from the substrate during ripping motion.

27. The multi-shank ripper excavation tool of claim 26, wherein said first ripper tooth is angularly advanced relative to said second ripper tooth in a direction of substrate ripping motion, whereby said first ripper tooth is engaged for ripping the substrate before said second ripper tooth is engaged for ripping the substrate.

28. The multi-shank ripper excavation tool of claim 26, said set of multiple shanks further comprises at least:

a third shank comprising a third ripper tooth disposed at a forward end thereof for ripping engagement with a substrate, said third shank being laterally spaced from said first shank and from said second shank along the axis of rotation of said multi-shank ripper excavation tool relative to the arm, and said third ripper tooth being angularly spaced from said first ripper tooth and from said second ripper tooth in a direction of ripping motion, said third ripper tooth being non-parallel with said first ripper tooth and said second ripper tooth, and a set of ripper tooth tips of said first ripper tooth, said second ripper tooth and said third ripper tooth being non-planar.

29. The multi-shank ripper excavation tool of claim 28, wherein said first ripper tooth is angularly advanced relative to said second ripper tooth in a direction of ripper rotation and said second ripper tooth is angularly advanced relative to said third ripper tooth in a direction of ripping rotation, whereby said first ripper tooth is engaged for ripping the substrate before said second ripper tooth and said third ripper tooth are engaged for ripping the substrate, and said second ripper tooth is engaged for ripping the substrate before said third ripper tooth is engaged for ripping the substrate.

30. The multi-shank ripper excavation tool of claim 28, wherein the arc of rotation extending generally through the ripper tooth tip of each of said third ripper tooth has said predetermined, substantially common radius.

31. The multi-shank ripper excavation tool of claim 28, wherein the arc of rotation extending generally through the ripper tooth tip of each said additional ripper tooth has said predetermined, substantially common radius.

32. The multi-shank ripper excavation tool of claim 26, said set of multiple shanks further comprises additional shanks, each comprising an additional ripper tooth disposed at a forward end thereof for ripping engagement with a substrate, each said additional shank being laterally spaced from each other shank along the axis of rotation of said multi-shank ripper excavation tool relative to the arm, and the said additional ripper tooth of each said additional shank being angularly spaced from the said additional ripper tooth of each other of said additional shanks in a direction of ripping motion, each said additional ripper tooth being non-parallel with each other of said ripper teeth, and of ripper teeth tips of each of the said additional ripper teeth being non-planar.

33. The multi-shank ripper excavation tool of claim 26, wherein said ripper tooth is replaceably mounted to said shank.

34. The multi-shank ripper excavation tool of claim 26, wherein said ripper tooth is integral with said shank.

35. The multi-shank ripper excavation tool of claim 26, wherein said body portion comprises a body upper portion and a body tubular cross brace portion.

36. The multi-shank ripper excavation tool of claim 26, wherein each said ripper tooth comprises a nosepiece adapter.

37. The multi-shank ripper excavation tool of claim 26, wherein said arc center is located near and generally above and forward of a dipper pivot rotation center.

38. The multi-shank ripper excavation tool of claim 26, wherein said predetermined angle is between about 20° and about 50° from the tangent.

39. The multi-shank ripper excavation tool of claim 26, wherein each said ripper tooth has a top cutting surface and a bottom cutting surface.

40. The multi-shank ripper excavation tool of claim 39, wherein each said top cutting surface is disposed at an angle of between about 35° and about 70° from the tangent.

41. The multi-shank ripper excavation tool of claim 26, wherein said ripping teeth are selected from the group consisting of: tiger points, twin or double tiger points, and crawler tractor ripping teeth.

42. The multi-shank ripper excavation tool of claim 26, wherein one or more of the ripping teeth comprises twin or double tiger points, and the twin or double tiger points of the one or more ripping teeth are spaced apart laterally and spaced apart angularly in a direction of ripping motion.

43. The multi-shank ripper excavation tool of claim 26, wherein said one or more plate members define one or more leading edges angled in a direction of angular spacing of said ripper teeth.

44. The multi-shank ripper excavation tool of claim 43, wherein one or more intermediate ripping teeth of said set of ripping teeth are mounted to said leading edge.

45. The multi-shank ripper excavation tool of claim 26, wherein said at least one set of multiple shanks comprises at least two sets of multiple shanks.

46. The multi-shank ripper excavation tool of claim 45, wherein said two sets of multiple shanks are arrayed in a mirror configuration.

47. The multi-shank ripper excavation tool of claim 45, wherein said two sets of multiple shanks are arrayed in a side-by-side transformation.

48. The multi-shank ripper excavation tool of claim 26, wherein the arm is a dipper arm.

49. The multi-shank ripper excavation tool of claim 26, wherein the arm is a boom arm.

50. The multi-shank ripper excavation tool of claim 26, wherein the arc of rotation extending generally through the ripper tooth tip of each of said first ripper tooth and said second ripper tooth has a predetermined, substantially common radius.

51. The multi-shank ripper excavation tool of claim 26 or claim 32 wherein said angular spacing between adjacent said ripper teeth in a direction of ripping motion is between about 15° and about 30°.

52. The multi-shank ripper excavation tool of claim 51, wherein angular spacing between adjacent said ripper teeth in a direction of ripping motion is about 20°.

53. A multi-shank ripper excavation tool for use mounted to an arm of an excavation machine, said multi-shank excavation tool comprising:

a body mounted for rotation from the arm, multiple shanks mounted to said body, each shank being disposed generally perpendicular to an axis of rotation of said multi-shank ripper excavation tool relative to the arm, one or more plate members mounted to span a region between two or more said shanks, rearward of said ripper teeth in a direction of ripping motion, and defining, with two or more of said shanks, a bucket volume for receiving material ripped from the substrate during ripping motion, said plates members defining a leading edge, and at least one set of multiple ripper teeth disposed for ripping engagement with a substrate, said set of multiple ripper teeth comprising a ripper tooth disposed at a forward end of each said shank and one or more ripper teeth mounted to said leading edge, in each set of multiple ripper teeth, a first said ripper tooth being disposed at a forward end of a first said shank, a second ripper tooth being laterally spaced from the first ripper tooth along the axis of rotation of said multi-shank ripper excavation tool relative to the arm, and said second ripper tooth being angularly spaced from said first ripper tooth in a direction of ripping motion and said first ripper tooth and said second ripper tooth each having a ringer tooth tip and being disposed at a predetermined angle to a tangent to an arc of rotation extending generally through its said ripper tooth tip, with an arc center at an axis of rotation of said ripper tooth tip and said first ripper tooth and said second ripper tooth being non-parallel.

54. The multi-shank ripper excavation tool of claim 53, wherein said leading edge is angled in a direction of angular spacing of said set of multiple ripper teeth.

55. The multi-shank ripper excavation tool of claim 53, wherein one or more of the ripping teeth comprises twin or double tiger points, and the twin or double tiger points of the one or more ripping teeth are spaced apart laterally and spaced apart angularly in a direction of ripping motion.

56. The multi-shank ripper excavation tool of claim 53, wherein the arm is a dipper arm.

57. The multi-shank ripper excavation tool of claim 53, wherein the arm is a boom arm.

58. The multi-shank ripper excavation tool of claim 53, wherein the arc of rotation extending generally through the ripper tooth tip of each of said first ripper tooth and said second ripper tooth has a predetermined, substantially common radius.

59. The multi-shank ripper excavation tool of claim 53 or claim 54, comprising at least two sets of multiple ripper teeth, wherein said leading edge defined by said plate members has at least two angular components and each angular component supports ripper teeth of discrete sets of multiple ripper teeth.

60. The multi-shank ripper excavation tool of claim 59, wherein said two angular components of said leading edge supporting ripper teeth of discrete sets of multiple ripper teeth are arrayed in a mirror configuration.

61. The multi-shank ripper excavation tool of claim 59, wherein said two angular components of said leading edge supporting ripper teeth of discrete sets of multiple ripper teeth are arrayed in a side-by-side transformation.

* * * * *